US012466625B1

(12) United States Patent
Biviano et al.

(10) Patent No.: US 12,466,625 B1
(45) Date of Patent: Nov. 11, 2025

(54) FLUID CONTAINER

(71) Applicant: Coral Spirits LLC, Conroe, TX (US)

(72) Inventors: Michael Biviano, San Antonio, TX (US); Marko Christopher Kaluderovic, Houston, TX (US)

(73) Assignee: Coral Spirits LLC, Conroe, TX (US)

( * ) Notice: Subject to any disclaimer, the term of this patent is extended or adjusted under 35 U.S.C. 154(b) by 0 days.

(21) Appl. No.: 18/641,278

(22) Filed: Apr. 19, 2024

Related U.S. Application Data

(60) Provisional application No. 63/461,222, filed on Apr. 21, 2023.

(51) Int. Cl.
*B65D 75/00* (2006.01)
*B65D 75/58* (2006.01)
*B65D 85/72* (2006.01)

(52) U.S. Cl.
CPC ..... *B65D 75/008* (2013.01); *B65D 75/5822* (2013.01); *B65D 85/72* (2013.01); *B65D 2205/02* (2013.01)

(58) Field of Classification Search
CPC .. B65D 75/008; B65D 75/5822; B65D 85/72; B65D 2205/02
USPC ..... 383/200
See application file for complete search history.

(56) References Cited

U.S. PATENT DOCUMENTS 3,166,226 A * 1/1965 Mobley ..... B65D 75/50 229/116
3,453,661 A * 7/1969 Repko ..... B65D 75/28 426/115
3,670,927 A * 6/1972 Hubbard ..... B65D 75/54 383/200
7,175,581 B2 * 2/2007 Murray ..... B29C 66/61 493/212
2002/0118895 A1 * 8/2002 Watabe ..... B65D 75/004 383/200
2009/0180718 A1 * 7/2009 Walker ..... B65D 75/008 383/202
2011/0064338 A1 * 3/2011 Surdziel ..... B65D 75/5816 383/207
2013/0279832 A1 * 10/2013 Burri ..... B65D 75/5811 493/264
2016/0083161 A1 * 3/2016 Moriz ..... B65D 75/008 383/104
2017/0283155 A1 * 10/2017 Mishkin ..... A23L 5/13
2019/0177016 A1 * 6/2019 Gross-Johnston ..... B65B 43/06
2020/0180843 A1 * 6/2020 Shimono ..... B65D 81/3461
2020/0399038 A1 * 12/2020 Nash ..... B65D 75/545
2022/0087457 A1 3/2022 Schwartz

* cited by examiner

*Primary Examiner* — Peter N Helvey
(74) *Attorney, Agent, or Firm* — Fish & Richardson P.C.

(57) ABSTRACT

A fluid container includes a flexible pouch formed of a foil material, the flexible pouch defining a fluid reservoir for containing a beverage, the flexible pouch including a front surface comprising a pierceable vent, wherein the pierceable vent is defined by a circular area of the front surface and a portion of the foil material present in the circular area has a thickness that is thinner than a thickness of another portion of the foil material external to the circular area of the pierceable vent, a back surface, being opposite the front surface, wherein the back surface and the front surface are sealed together to form the fluid reservoir, and a perforated portion comprising a portion of the front surface and a portion of the back surface.

30 Claims, 23 Drawing Sheets

FLUID CONTAINER

PRIORITY

This application claims priority under 35 USC § 119(e) to U.S. Provisional Patent Application Ser. No. 63/461,222, filed on Apr. 21, 2023.

TECHNICAL FIELD

This disclosure relates to a fluid container.

BACKGROUND

People use fluids for a multitude of reasons. For example, people consume beverages to hydrate themselves. The beverages can be stored in containers. For example, the containers can be portable so that the beverages are portable. Some portable containers are disposable.

SUMMARY

The present systems and methods provide an easy to use, portable container to store fluids, e.g., beverages. For example, a portable container can include a disposable foil pouch that contains a beverage. The pouch can include a tear line that allows a user to tear the pouch open to access the beverage contained within the pouch. The tear line can be provided at a location on the pouch (e.g., a top corner of the pouch) that allows a user to easily drink the beverage. The pouch can also include a pierceable hole that is initially closed, but can be pierced to allow the user to insert a straw into the pouch. The pierceable hole can also be used as a vent so that the beverage can easily be poured after a user tears the pouch at the tear line. For example, air can enter the pierceable hole as the user pours the beverage from the pouch. This can be advantageous, e.g., because the beverage can be poured quickly and with little effort by the user.

In an aspect, a fluid container includes a flexible pouch formed of a foil material, the flexible pouch defining a fluid reservoir for containing a beverage. The flexible pouch includes a front surface including a pierceable vent, wherein the pierceable vent is defined by a circular area of the front surface and a portion of the foil material present in the circular area has a thickness that is thinner than a thickness of another portion of the foil material external to the circular area of the pierceable vent. The flexible pouch also includes a back surface, being opposite the front surface, wherein the back surface and the front surface are sealed together to form the fluid reservoir. The flexible pouch includes a perforated portion including a triangular shaped portion of the front surface and a triangular shaped portion of the back surface, the triangular shaped portion of the front surface including a perforated edge and the triangular shaped portion of the back surface including a perforated edge, wherein the triangular shaped portion of the front surface is located opposite the triangular shaped portion of the back surface, the perforated edge of the front surface extends across the front surface at a 45° angle relative to an edge of the front surface and the perforated edge of the back surface extends across the back surface at a 45° angle relative to a side of the back surface, wherein separating a portion of the perforated portion from the front surface and the back surface exposes the fluid reservoir for user access. The flexible pouch also includes a base including a front base portion that extends below the front surface and a back base portion that extends below the back surface, wherein the base provides a bottom wall to the fluid reservoir and allows the flexible pouch to stand upright when the fluid reservoir is beverage filled. The pierceable vent is configured to allow air to enter the fluid reservoir as fluid is being removed from the fluid reservoir by an opening provided by the portion of the perforated portion being separated from the front surface and the back surface.

In some embodiments, the foil material comprises at least one of polyvinylidene chloride (PVC) and low-density polyethylene (LDPE).

In some embodiments, the pierceable vent has a diameter in a range of 1 millimeter to 10 millimeters.

In some embodiments, the pierceable vent has a diameter of 4 millimeters.

In some embodiments, the fluid reservoir is configured to hold between eight ounces and ten ounces of fluid.

In some embodiments, the perforated portion extends 25 millimeters from a top of the flexible pouch.

In some embodiments, the front surface comprises indicia to indicate the location of the pierceable vent.

In some embodiments, the flexible pouch has a height in a range of 150 millimeters to 300 millimeters.

In some embodiments, the flexible pouch has a width in a range of 100 millimeters to 150 millimeters.

In some embodiments, the pierceable vent is located 25 millimeters from a top of the flexible pouch.

In another aspect, a fluid container includes a flexible pouch formed of a foil material, the flexible pouch defining a fluid reservoir for containing a beverage. The flexible pouch includes a front surface comprising a pierceable vent, wherein the pierceable vent is defined by a circular area of the front surface and a portion of the foil material present in the circular area has a thickness that is thinner than a thickness of another portion of the foil material external to the circular area of the pierceable vent. The pierceable pouch also includes a back surface, being opposite the front surface, wherein the back surface and the front surface are sealed together to form the fluid reservoir. The flexible pouch includes a perforated portion comprising a rectangular shaped portion of the front surface of the pouch and a rectangular shaped portion of the back surface of the pouch. The rectangular shaped portion of the front surface includes a perforated edge and the rectangular shaped portion of the back surface includes a perforated edge, wherein the rectangular shaped portion of the front surface is located opposite the rectangular shaped portion of the back surface. The perforated edge of the front surface extends across the front surface perpendicularly relative to an edge of the front surface and the perforated edge of the back surface extends across the back surface perpendicularly relative to a side of the back surface, wherein separating a portion of the perforated portion from the front surface and the back surface exposes the fluid reservoir for user access. The flexible pouch also includes a base comprising a front base portion that extends below the front surface and a back base portion that extends below the back surface, wherein the base provides a bottom wall to the fluid reservoir and allows the flexible pouch to stand upright when the fluid reservoir is beverage filled, wherein the pierceable vent is configured to allow air to enter the fluid reservoir as fluid is being removed from the fluid reservoir by an opening provided by the portion of the perforated portion being separated from the front surface and the back surface.

In some embodiments, the foil material comprises at least one of polyvinylidene chloride (PVC) and low-density polyethylene (LDPE).

In some embodiments, the pierceable vent has a diameter in a range of 1 millimeter to 10 millimeters.

In some embodiments, the pierceable vent has a diameter of 6 millimeters.

In some embodiments, the fluid reservoir is sized to hold between eight ounces and ten ounces of fluid.

In some embodiments, the perforated portion of the pouch extends 25 millimeters from a top of the flexible pouch.

In some embodiments, the front surface of the pouch comprises indicia to indicate the location of the pierceable vent.

In some embodiments, the flexible pouch has a height in a range of 150 millimeters to 300 millimeters.

In some embodiments, the flexible pouch has a width in a range of 100 millimeters to 150 millimeters.

In some embodiments, the center of the pierceable vent is located 25 millimeters from a top of the flexible pouch.

The details of one or more embodiments of the subject matter described herein are set forth in the accompanying drawings and the description below. Other features, objects, and advantages of the subject matter will be apparent from the description and drawings, and from the claims.

DESCRIPTION OF DRAWINGS

Like reference numbers and designations in the various drawings indicate like elements.

DETAILED DESCRIPTION

The present systems and methods provide an easy to use, portable container to store fluids, e.g., beverages. For example, a portable container can include a disposable foil pouch that contains a beverage. The pouch can include a tear line (e.g., a perforated tear line) that allows a user to tear the pouch open to access the beverage contained within the pouch. The tear line can be provided at a location on the pouch (e.g., a top corner of the pouch) that allows a user to easily drink the beverage, empty the beverage into another container (e.g., a cup), etc. The pouch may include a front surface comprising a pierceable vent and a back surface, being opposite the front surface, wherein the back surface and the front surface are sealed together to form the fluid reservoir. The pierceable vent may be configured to allow air to enter the fluid reservoir as fluid is being removed from the fluid reservoir by an opening provided by the portion of the perforated portion being separated from the front surface and the back surface.

Figure 1:
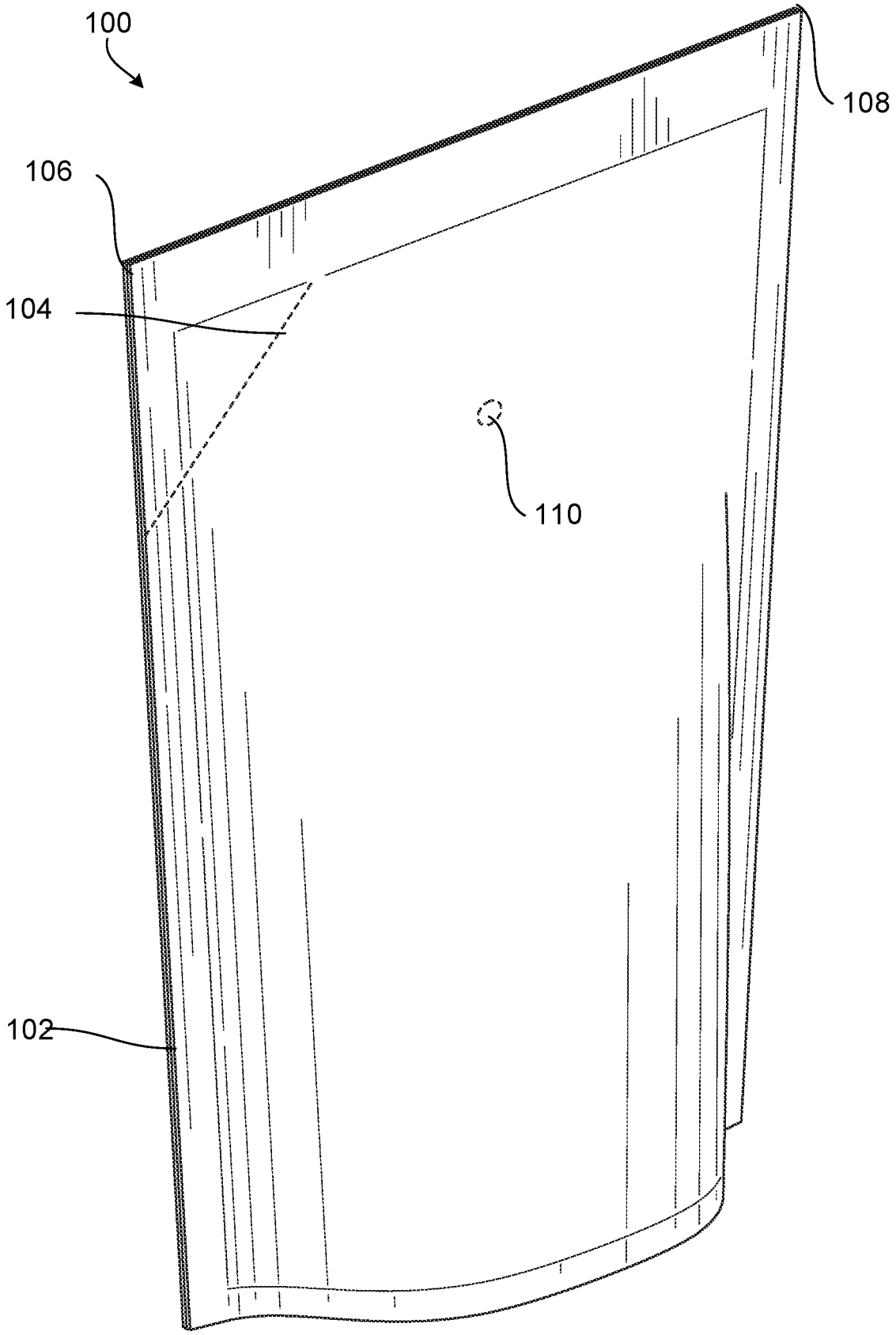
FIG. 1 is a perspective view of a fluid container.

FIG. 1 illustrates a fluid container 100 that is formed by a flexible, disposable pouch 102. The pouch 102 can be a metal foil material, e.g., including aluminum, tin, copper, etc. In some implementations, the pouch 102 can include plastics, e.g., including polyvinylidene chloride (PVC), low-density polyethylene (LDPE), etc. In some implementations, the pouch 102 can be formed of a combination of one or more metals and one or more plastics. In some implementations, the pouch 102 can include one or more layers of material. For example, multiple layers (e.g., double layers) can be used to insulate the fluid within the container 100.

The pouch 102 can be sized to hold a variety of fluids. For example, the pouch 102 can be sized to hold 5 ounces, 10 ounces, 15 ounces, etc. In some implementations, the pouch is sized to hold between 8 ounces and 10 ounces of fluid. In some implementations, the pouch is sized to hold between 9 and 10 ounces of fluid. In some implementations, the pouch is sized to hold between 8 and 20 ounces of fluid.

The pouch 102 includes a tear line 104 on a top corner 106 of the pouch 102. The tear line 104 can include, e.g., one or more perforations in the pouch 102, a section of the pouch 102 having thinner walls, etc. In some implementations, the tear line 104 can include a pre-made tear on at least a portion of the corner 106. The pre-made tear can allow a user to more easily tear a portion of the pouch; for example, the corner 106 off the pouch 102 can be partially or completely torn off. In some implementations, the tear line 104 can include a perforation (e.g., a series of holes that serves as an aid in separation). Different geometries of perforation can be used. For example, the holes can be, e.g., slits, circular holes, triangular holes, etc. The perforations can be formed by, e.g., pinner perforation rollers, die and punch, laser perforation, etc. The perforation creates a long series of slits so that the plastic material can be torn easily along the tear line 104. Once the user tears the corner 106 off the pouch 102, the user can access the fluid (e.g., beverage) contained within the pouch 102. In some implementations, the pouch 102 includes a tear line on a second top corner 108 of the pouch. In some implementations, the pouch 102 includes a tear line on both top corners 106, 108 or at other locations of the pouch.

The pouch 102 also includes a pierceable hole 110. The hole 110 can include, e.g., a perforation in the pouch 102, a section of the pouch 102 having thinner walls, a section of the pouch 102 having a plastic film, etc. to allow a user to easily pierce the hole, e.g., with a straw. In some implementations, the hole 110 has a circular geometry (e.g., a 4 mm diameter, a 6 mm diameter, etc.); however, one or more other geometries maybe utilized (e.g., rectangular shapes, etc.). The pouch 102 can include indicia to indicate the location of the pierceable hole 110. For example, text on the pouch 102 can indicate the location of the hole 110. In some implementations, colors of the pouch 102 can indicate the location of the hole 110. In some implementations, the hole 110 can act as a hole for a straw so that a user can drink the beverage through a straw. In some implementations, the hole 110 can act as a vent. For example, the hole 110 can act as a vent when a user tears the top corner 106 off the pouch 102. If the user wants to drink the beverage from the torn corner or pour the beverage from the top corner, the vent can allow air to enter the pouch 102. Allowing air to enter the pouch assists the user in drinking and pouring the beverage, so that little effort is required by the user. Additionally, allowing the user to drink from the pouch with a straw may provide increased comfort to the user, as this limits the user's and other's access to the liquid within the pouch.

The size, position, etc. of the hole 110 can vary. For example, in some implementations, the hole 110 can be located on a side of the pouch. In some implementations the hole 110 can be larger, and in some implementations the hole 110 can be smaller. In some implementations, the fluid container 100 can include multiple holes. The multiple holes can be similar or different from each other (e.g., similar or different geometries, sizes, shapes, etc.).

Figure 2:
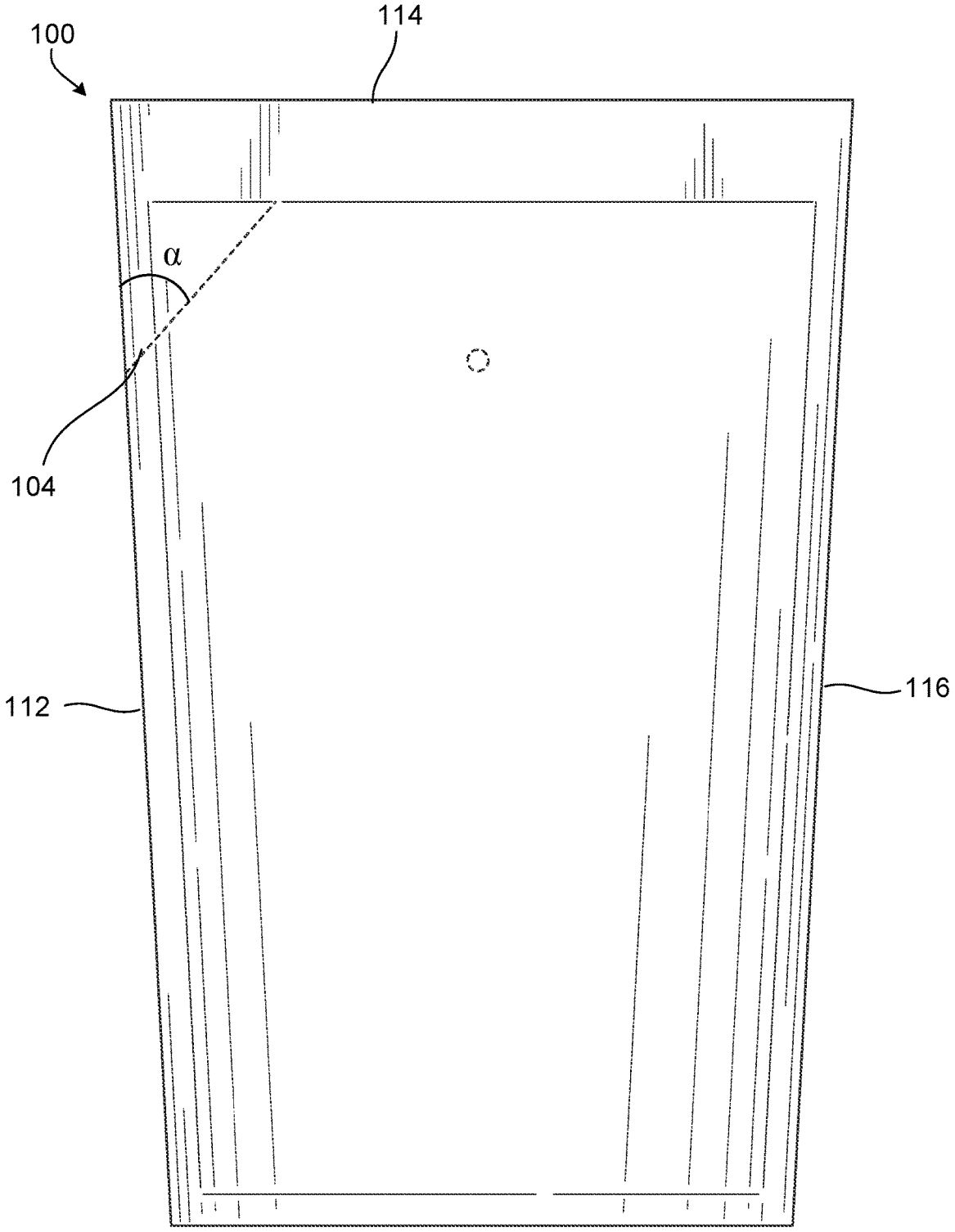
FIG. 2 is a front view of a fluid container.

FIG. 2 illustrates front view of the fluid container 100. The tear line 104 is presented normal to the view presented in FIG. 2. The tear line 104 can extend at an angle α from a side 112 of the pouch 102 towards the top 114 of the pouch. In some implementations, the angle α can be an acute angle, e.g., in a range of 0°-89°, a range of 10°-80°, a range of 30°-60°, a 45° angle, a 50° angle, a 30° angle, etc. In some implementations, a first tear line extends across the front side of the pouch and a second tear line extends across the back side of the pouch at an angle α. The perforated edge of the front surface may extend across the front surface at the angle α relative to an edge of the front surface and the perforated edge of the back surface extends across the back surface at angle α relative to a side of the back surface. Separating a portion of the perforated portion from the front surface and the back surface exposes the fluid reservoir for user access. The angle of the tear line can be designed such that a desired portion of the pouch 102 tears off. For example, a larger angle removes a larger portion of the pouch 102. A lesser angle removes a smaller portion of the pouch 102. The angle α can also be designed such that a user is comfortable drinking from the pouch 102. For example, a greater angle α tears off a larger portion of the top 114 of the pouch, and a lesser angle α tears off a smaller portion of the top 114 of the pouch. A user may be more comfortable with his or her mouth covering a larger portion of the top 114 of the pouch. In some implementations, a greater angle α allows the user to tear the entire top portion of the pouch for improved access. A greater angle α also allows increased access the liquid inside the pouch, enabling users to pour additional liquid into the pouch, or to add various desired ingredients to the pouch (e.g. liquid IV, vitamin C, water flavoring powder, etc.). In other implementations, the tear line can be configured to tear from the top 114 of the pouch towards the side 112 of the pouch. In yet another implementation, the tear line can be configured to tear from the side 112 of the pouch towards the top 114 of the pouch. The tear line 114 can define a triangular shaped portion in the corner 106 of the pouch 102.

In some implementations, the surfaces near the tear line can be smooth, such that the user is comfortable placing his or her mouth on the pouch. For example, the tear line can be configured such that a smooth edge is left on the pouch. This can prevent a user from cutting his or her lips, fingers, etc. while drinking from the pouch.

The geometry of the pouch 102 can vary. In the illustrated embodiment, sides 112, 116 of the pouch are not parallel. For example, the sides 112, 116 are tapered. In some embodiments, the sides 112, 116 are parallel. In some implementations, the sides 112, 116 can include surface features (e.g., grips, features that increase friction, etc.) to assist a user with holding the pouch.

Figure 3:
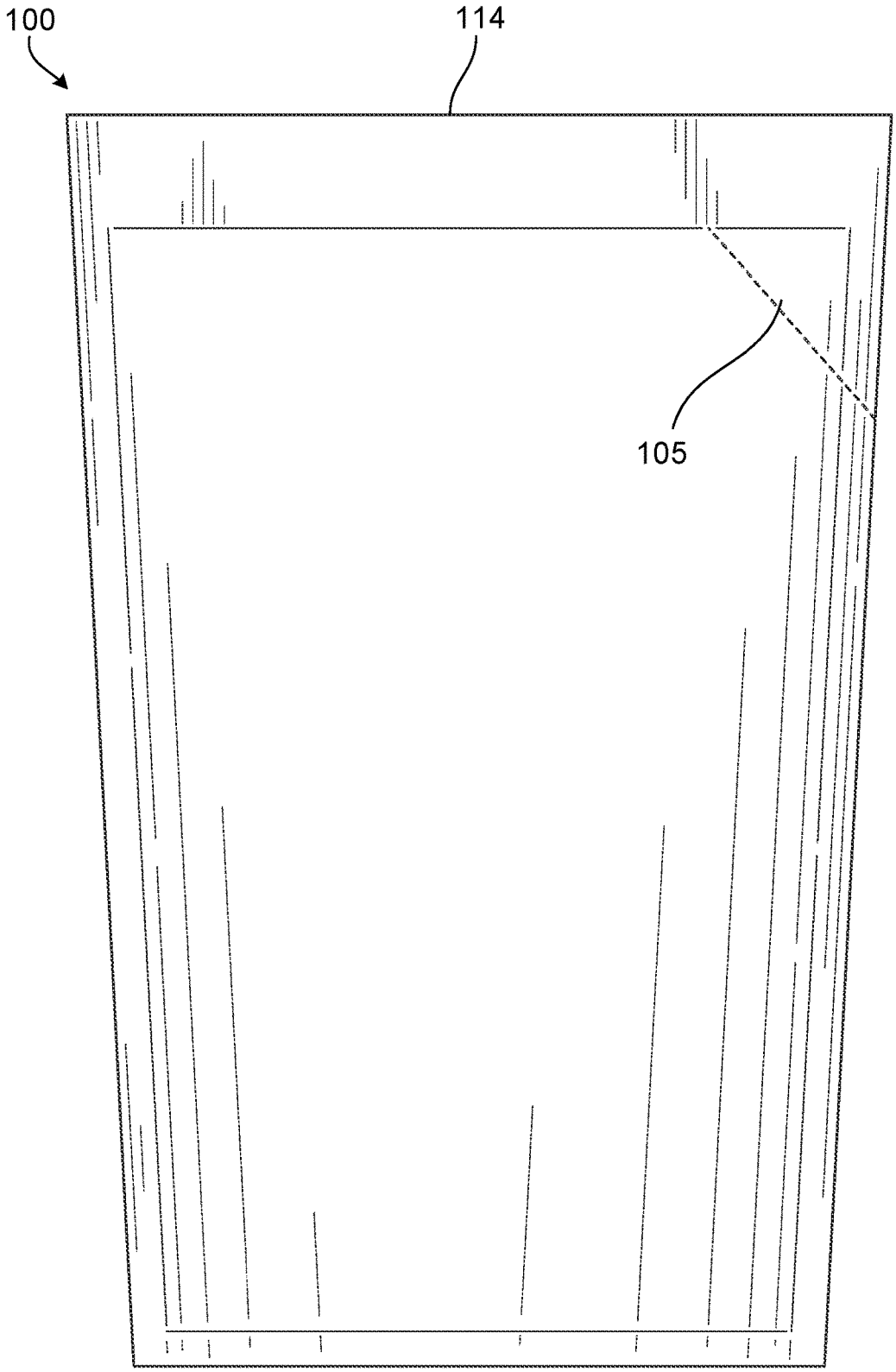
FIG. 3 is a back view of a fluid container.

FIG. 3 illustrates a back view of the fluid container 100. In the illustrated implementation, the back of the pouch 102 does not include a pierceable hole; however, in some implementations, the back of the pouch 102 includes a hole similar to the hole 110. In some implementations having a hole on the back of the pouch, the hole on the back of the pouch 102 can be different than a hole on the front of the fluid container. In some implementations, the pouch 102 can have a hole on the back of the pouch, and the pouch does not have a hole on the front of the pouch. The back of the pouch 102 also includes a tear line 105. The tear line 105 can be similar to the tear line 104 that is on the front of the pouch, or the tear line 105 can be different from the tear line 104, as discussed further below.

Figure 4:
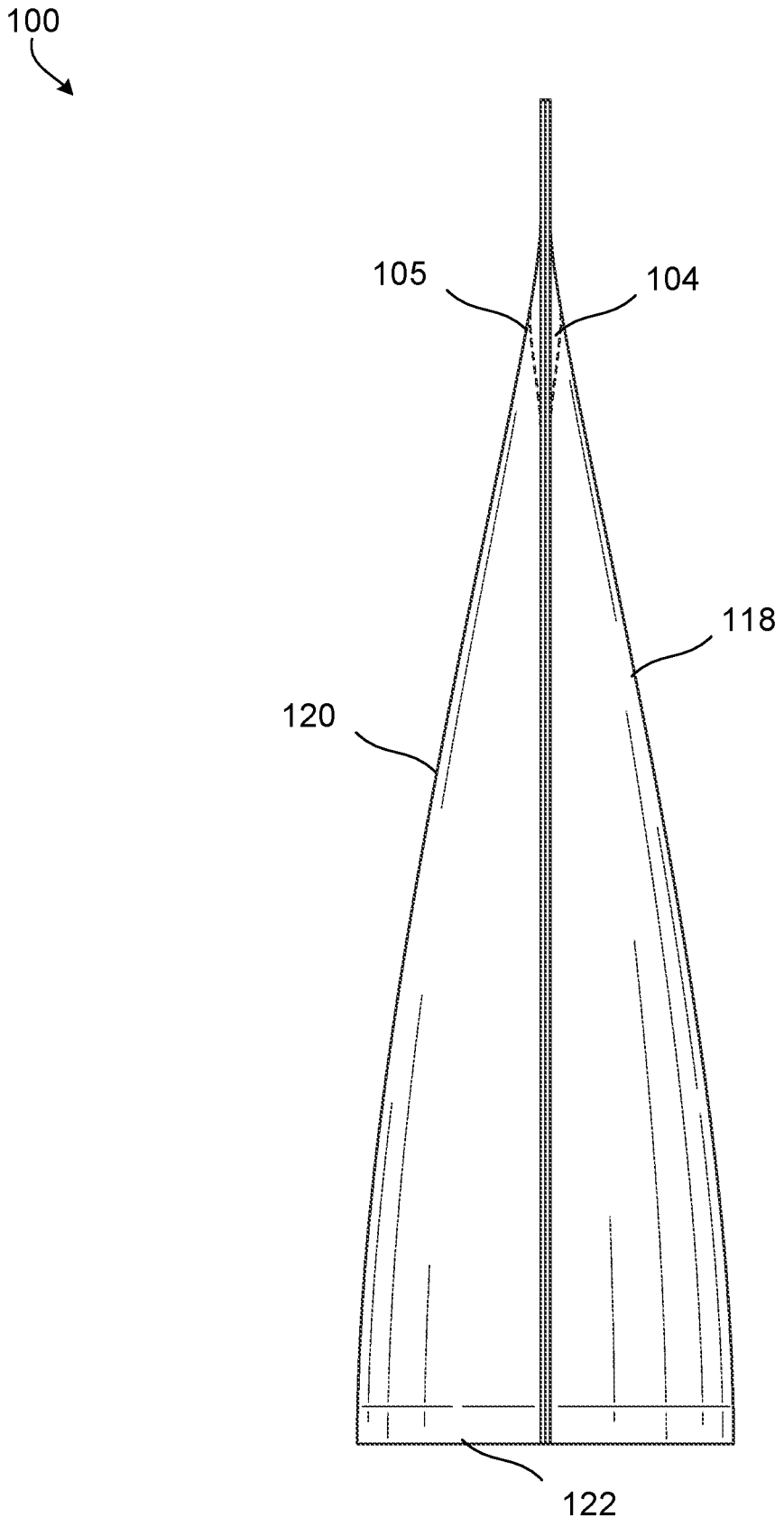
FIG. 4 is a left side view of a fluid container.
Figure 5:
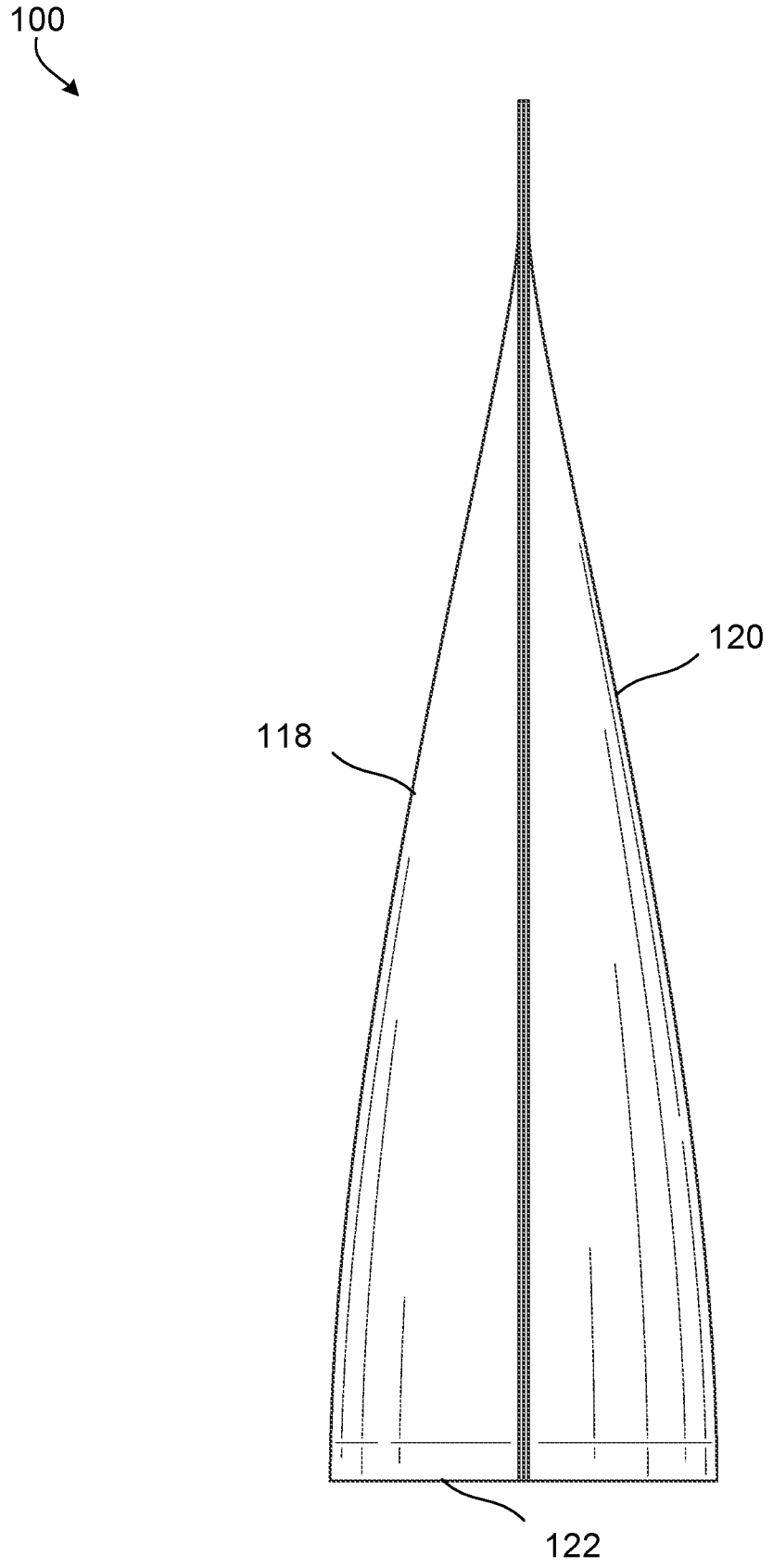
FIG. 5 is a right side view of a fluid container.

FIGS. 4 and 5 illustrate a left side view of the fluid container 100 and a right side view of the fluid container 100, respectively. Tear lines 104, 105 are illustrated in the left side view of the fluid container 100. As illustrated, the tear line 104 appears on a front side 118 and tear line 105 appears on a back side 120 of the fluid container to define triangular shaped portions on the front surface and back surface of the pouch 102. This allows a user to easily tear through the front side 118 and the back side 120 of the pouch. In some implementations, the front side 118, the back side 120, other portions of the pouch, etc. can include surface features (e.g., grips, features that increase friction, etc.) to assist a user with holding the pouch. Although the tear lines 104, 105 are illustrated as symmetric, in some embodiments, the tear lines can be different (e.g., asymmetric). For example, the tear line 104 can extend at a different angle than the tear line 105. In some implementations, the tear line 104 can extend a different distance than the tear line 105. In some implementations, the tear line 104, the tear line 105, or both of the tear lines 104, 105 can be curved. For example, the same, similar, or different curves can be used on the front and back tear lines. For example, the front tear line 104 can have a particular curve (e.g., having a particular radius) and the back tear line 105 can have a same curve rotated at 180 degrees.

When filled with liquid, the pouch 102 is thicker at a bottom 122 of the pouch than at the top 114 of the pouch. The weight distribution of the liquid contained within the pouch 102 allows the pouch to stand upright, e.g., so that liquid does not spill from the hole 110 or an open corner of the pouch 102. The pouch 102 becomes flatter as liquid is removed from the pouch. Because the pouch 102 is flexible, a user can easily deform the pouch 102 to a desired shape. For example, the user can squeeze the pouch 102 to remove liquid from the pouch 102 at a faster rate.

Figure 6:
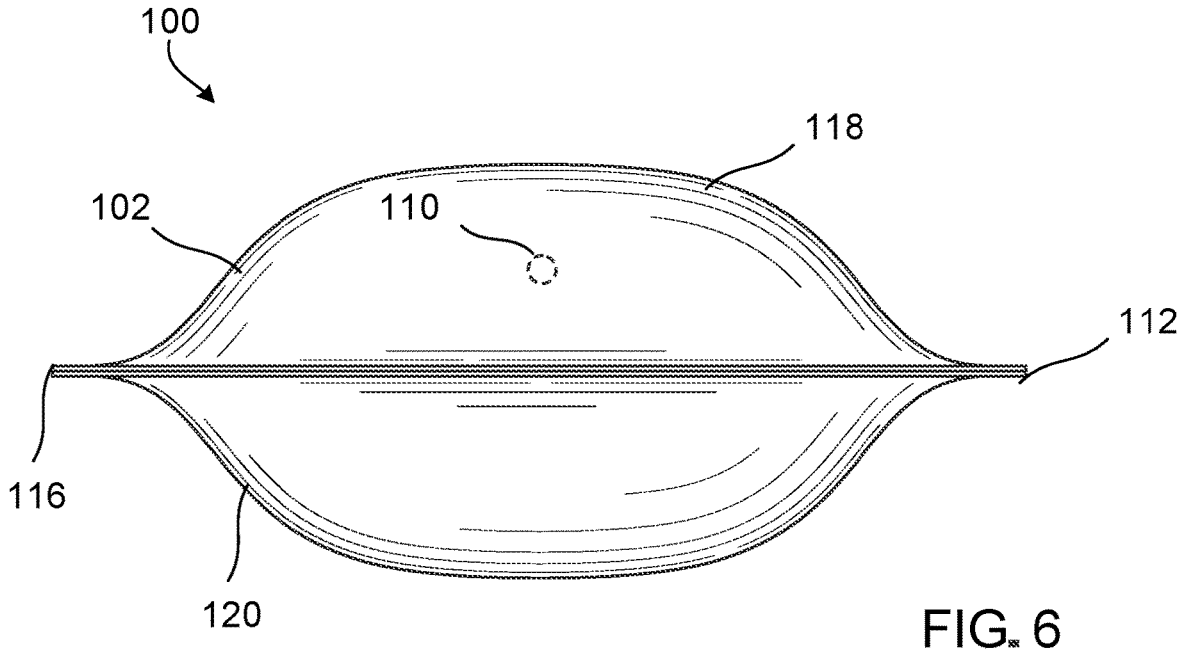
FIG. 6 is a top view of a fluid container.

FIG. 6 illustrates a top view of the fluid container 100. The hole 110 is visible on the front side 118 of the pouch 102. In some implementations, the hole 110 is closer to the top 114 of the pouch 102 or closer to one of the sides 112, 116 of the pouch. In some implementations, the front side 118 and the back side 120 extend a smaller distance from the center of the pouch, e.g., to form a thinner pouch. As discussed above, the weight distribution of the pouch can be designed, e.g., to allow the pouch to stand upright.

Figure 7:
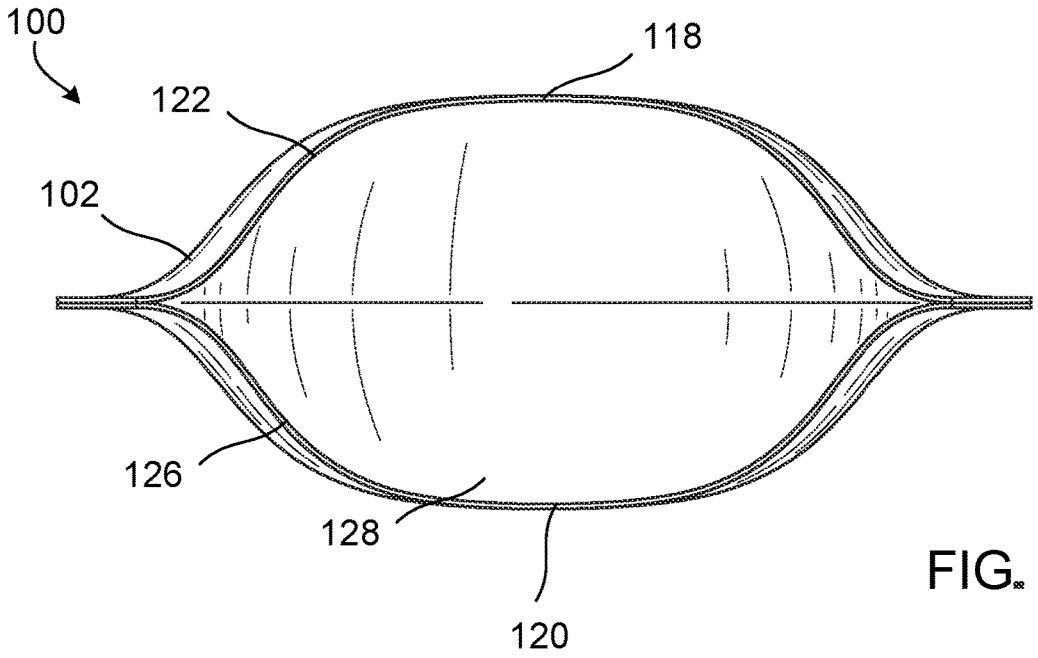
FIG. 7 is a bottom view of a fluid container.

FIG. 7 illustrates a bottom view of the fluid container 100. The pouch 102 includes two lips 124, 126 that form a base extending from the bottom of the pouch 102 to stand the pouch 102 upright. The front lip 124 extends forming a front base portion on the front side 118 of the pouch and the back lip 126 extends from the back side 120 of the pouch to form a back base portion of the pouch. The bottom of a reservoir 128 of the pouch is surrounded by the two lips 124, 126. The bottom of the reservoir 128 can have varying geometries (e.g., a domed geometry) based on the amount of fluid in the reservoir 128. For example, the geometry of the reservoir 128 can change as the amount of fluid in the container 100 changes. The lips 124, 126 extending from the bottom of the pouch 102 and surrounding the bottom of the reservoir 128 can provide a stable surface for the pouch 102 to stand upright regardless of the geometry of the bottom of the reservoir 128.

Figure 8:
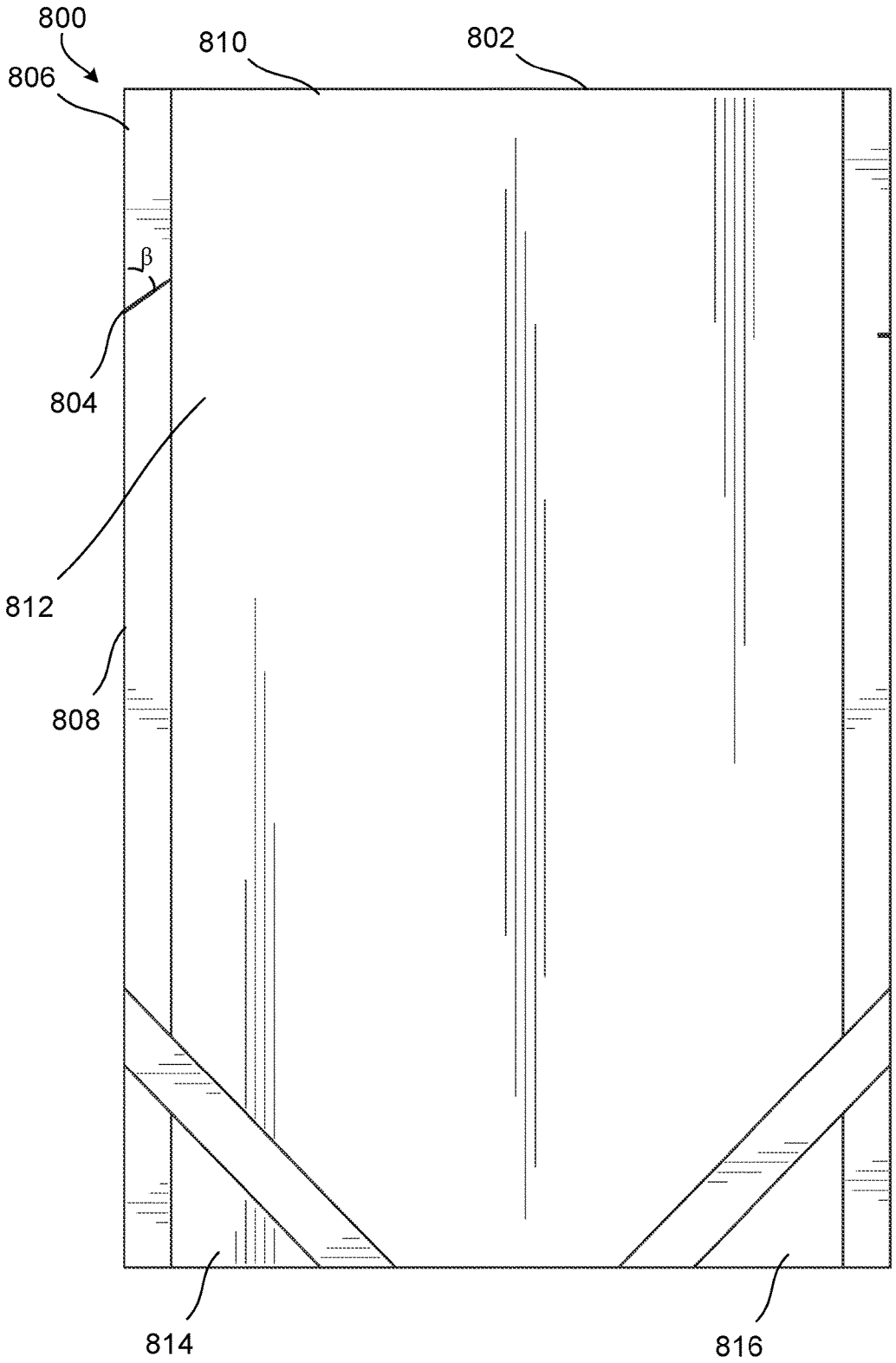
FIG. 8 is a front view of a fluid container that is empty.

FIG. 8 illustrates a front side view of a fluid container 800 that is empty (e.g., contains no fluid). The fluid container 800 is formed by a flexible, disposable pouch 802. The pouch 802 can be a metal foil material, e.g., including aluminum, tin, copper, etc. In some implementations, the pouch 802 can include plastics, e.g., including polyvinylidene chloride (PVC), low-density polyethylene (LDPE), etc. In some implementations, the pouch 802 can be formed of a combination of metals and plastics. In some implementations, other materials can be used alone or in combination with metals and plastics.

The pouch 802 includes a tear line 804 in a top corner 806 of the pouch. In the illustrated embodiment, the tear line 804 includes a pre-made tear on at least a portion of the corner 806 of the pouch. In some implementations, the tear line 804 can include, e.g., a perforation in the pouch 802, a section of the pouch 802 having thinner walls, etc. The tear line can allow a user to more easily tear the corner 806 off the pouch 802. For example, the pre-made tear provides a beginning for the user to tear the rest of the corner 806 off the pouch. The user therefore does not have to use a lot of effort to start the tear in the corner.

The tear line 804 extends from a side 808 of the pouch towards the top 810 of the pouch. The tear line 804 can extend at an angle β from the side 808 of the pouch 802 towards the top 810 of the pouch. In some implementations, the angle β can be an acute angle, e.g., in a range of 0°-89°, a range of 10°-80°, a range of 30°-60°, a 45° angle, a 50° angle, a 30° angle, etc. The angle of the tear line can be designed such that a desired portion of the pouch 802 tears off. For example, a greater angle removes a larger portion of the pouch 802. A lesser angle removes a smaller portion of the pouch 802. As discussed above, the angle β can also be designed such that a user is comfortable drinking from the pouch 802. For example, a greater angle β tears off a larger portion of the top 810 of the pouch, and a lesser angle β tears off a smaller portion of the top 810 of the pouch. A user may be more comfortable with his or her mouth covering a larger portion of the top 810 of the pouch.

The pre-made tear extends from the side 808, but does not extend into the reservoir 812 of the pouch 802. The pouch 802 can include material (e.g., foil material) that extends from the reservoir 812 to the sides 808, 814. This allows the pre-made tear 804 to extend from the side 808 of the pouch 802 without opening the reservoir 812 to the atmosphere. For example, no liquid can exit the pre-made tear 804. The reservoir 812 remains sealed until a user tears off a larger portion of the pouch 802. This can allow a user to easily transport the container 800 without spilling the fluid in the container.

The bottom of the pouch 802 includes additional foil material 814, 816 that extends from the reservoir 812. The additional foil material 814, 816 can be bent to a desired shape to provide a surface for the pouch 802 to stand upright. For example, the additional foil material 814, 816 can be similar to the lips 122, 124 of FIG. 7. The bottom of the reservoir 812 can have varying geometries (e.g., a domed geometry) based on the amount of fluid in the reservoir 812 (e.g., when the pouch 802 is filled with fluid). For example, the geometry of the reservoir 812 can change as the amount of fluid in the container 800 changes. The additional foil material 814, 816 extending from the bottom of the pouch 802 can provide a stable surface for the pouch 802 to stand upright regardless of the geometry of the bottom of the reservoir 812.

Figure 9:
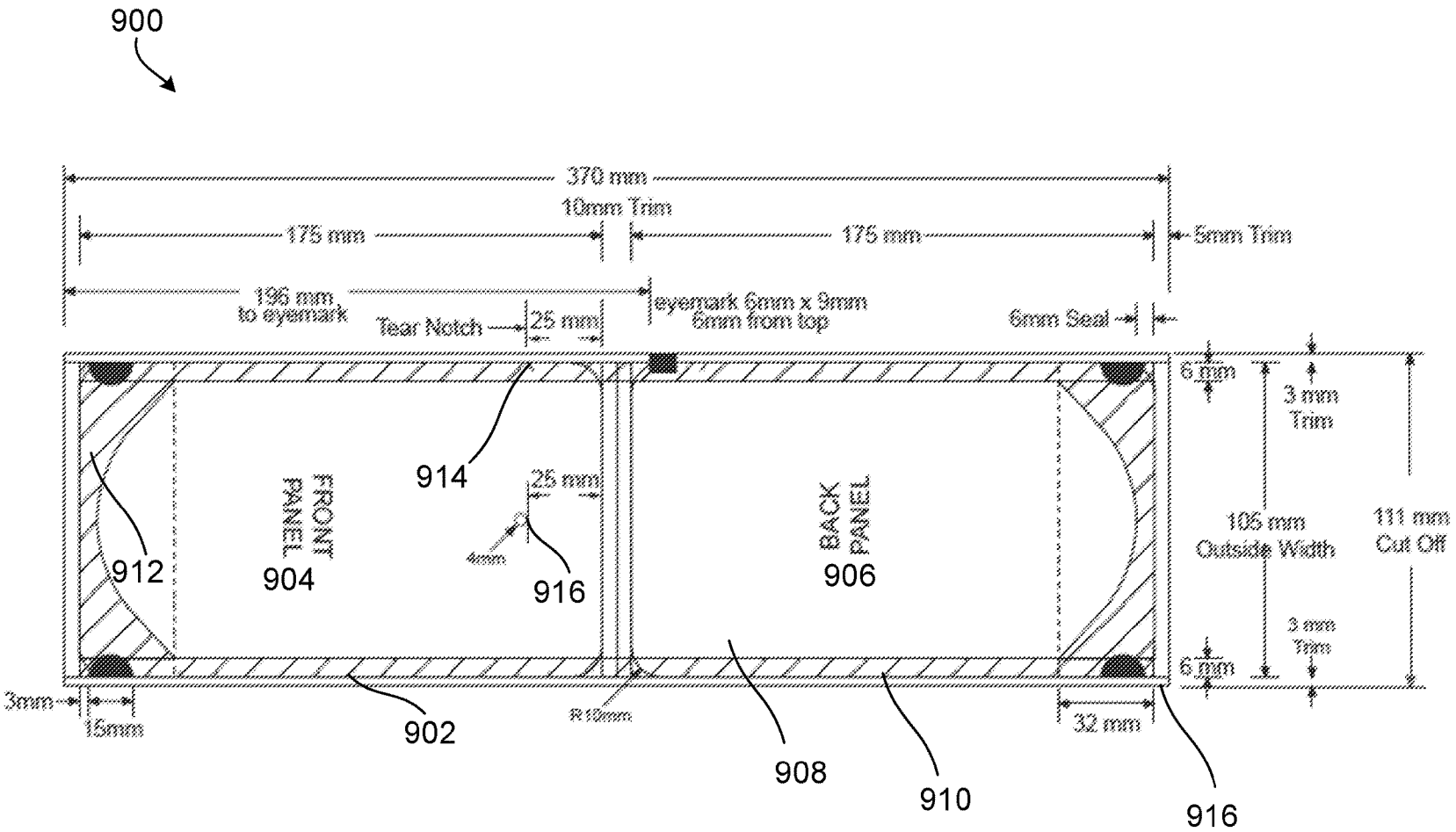
FIG. 9 is an engineering drawing of a fluid container.

FIG. 9 illustrates an engineering drawing of a fluid container 900. The fluid container 900 can be similar to, e.g., the fluid container 100 of FIG. 1. The fluid container 900 is formed by a flexible, disposable pouch 902. The pouch 902 can be a metal foil material, e.g., including aluminum, tin, copper, etc. In some implementations, the pouch 902 can include plastics, e.g., including polyvinylidene chloride (PVC), low-density polyethylene (LDPE), etc. In some implementations, the pouch 902 can be formed of a combination of metals and plastics.

The pouch container 902 includes a front panel 904 and a back panel 906. When the front panel 904 and the back panel 906 are sealed together, they form a reservoir 908 that can contain fluid, e.g., a beverage. For example, a container edge 910 surrounding the reservoir 908 can seal the front panel 904 to the back panel 906. Additional foil material 912 can be included on the bottom of the reservoir 908, e.g., to provide a surface for the pouch 902 to stand upright, as discussed above. In some implementations, a trim 916 surrounds the pouch container 902 during manufacturing. The trim 916 can be removed after or during the manufacturing process and does not remain on the finished product. The trim 916 can have a width of, e.g., between 1 mm to 5 mm, such as 3 mm.

The pouch 902 includes a pre-made tear 914 in a portion of the container edge 910. For example, the pre-made tear provides a beginning for the user to tear a corner off the pouch 902. The user therefore does not have to use a lot of effort to start the tear in the corner, as discussed above. The pre-made tear 914 extends into the container edge 910 without extending into the reservoir 908. For example, no liquid can exit the pre-made tear 914 because the pre-made tear does not extend into the reservoir 908. The reservoir 908 remains sealed until a user tears off a larger portion of the pouch 902. This can allow a user to easily transport the container 900 without spilling the fluid in the container. In some implementations, the pre-made tear 914 is about 25 millimeters (mm) from the top of the pouch 902.

The pouch 902 includes a pierceable hole 916 in the front panel 904. The hole 916 can be similar to the hole 110 of FIG. 1. The hole 916 can include, e.g., a perforation in the pouch 902, a section of the pouch 902 having thinner walls, etc. to allow a user to easily pierce the hole, e.g., with a straw, toothpick, etc. The pouch 902 can include indicia to indicate the location of the pierceable hole 916. For example, text on the pouch 902 can indicate the location of the hole 916. In some implementations, colors of the pouch 902 can indicate the location of the hole 916. In some implementations, the hole 916 can act as a hole for a straw so that a user can drink the beverage through a straw. In some implementations, the hole 916 can act as a vent. For example, the hole 916 can act as a vent when a user tears the top corner off the pouch 902, e.g., using the pre-made tear 914. If the user wants to drink the beverage from the torn corner or pour the beverage from the top corner, the vent can allow air to enter the pouch 902. Allowing air to enter the pouch assists the user in drinking and pouring the beverage, so that little effort is required by the user. The hole 916 can have a diameter in a range of about 1 mm to about 10 mm (e.g., 4 mm as illustrated). In some implementations, the hole 916 is about 25 mm from the top of the pouch. For example, a part of the circumference of the hole 916 can be about 25 mm from the top of the pouch.

The pouch 902 can generally have a width in a range of about 100 mm to about 150 mm (e.g., 111 mm as illustrated). The pouch can have a height in a range of about 150 mm to about 300 mm (e.g., 185 mm as illustrated). The pouch 902 can also have heights and widths outside of these ranges. In some implementations, the container edge 910 can have a width in a range of about 3 mm to about 10 mm (e.g., 6 mm as illustrated). The thickness of the pouch 902 can vary depending on the amount of liquid in the pouch 902. In some implementations, the thickness of the pouch 902 can be in a range of about 60 mm to about 65 mm.

Figure 10:
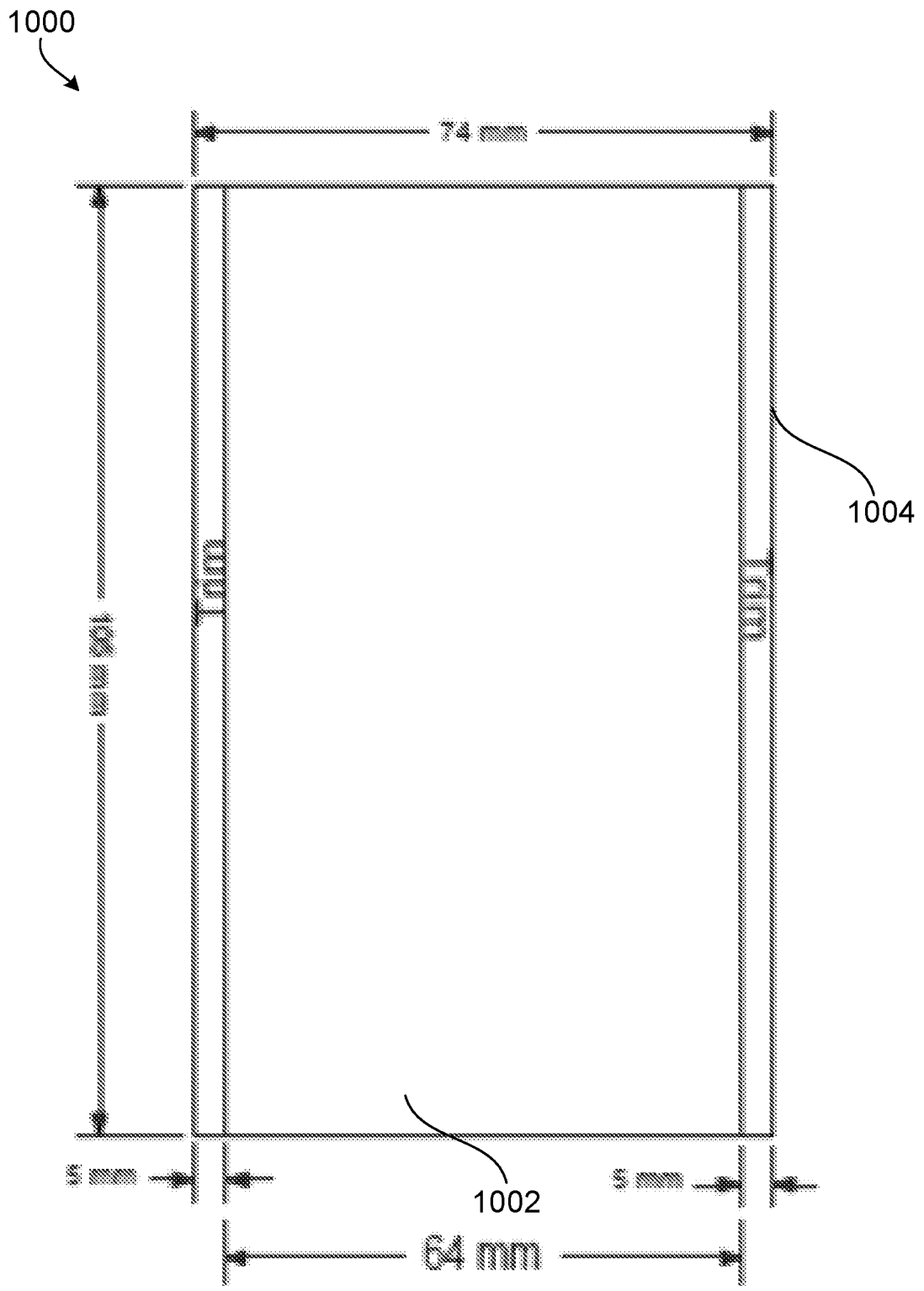
FIG. 10 is an engineering drawing of a gusset forming the bottom of a fluid pouch.

FIG. 10 illustrates an engineering drawing of a gusset 1000 for forming the bottom of a fluid container. For example, the gusset 1000 can be used to form the bottom of the reservoir 128 of the pouch 102, illustrated in FIG. 7. The gusset 1000 is formed by a flexible, disposable material 1002, e.g., a metal foil material, e.g., including aluminum, tin, copper, etc. In some implementations, the material 1002 can include plastics, e.g., including polyvinylidene chloride (PVC), low-density polyethylene (LDPE), etc. In some implementations, the material 1002 can be formed of a combination of metals and plastics.

The gusset 1000 has a width in a range of about 50 mm to about 100 mm (e.g., 74 mm as illustrated). The pouch 1000 has a height in a range of about 75 mm to about 150 mm (e.g., 105 mm as illustrated). The pouch can also have heights and widths outside of these ranges. The gusset 1000 can include a trim 1004 that surrounds the pouch 1002 during manufacturing. The trim 1004 can be removed after or during the manufacturing process and does not remain on the finished product. The trim 1004 can have a width of, e.g., between 1 mm to 5 mm, such as 3 mm or 5 mm.

Figure 11:
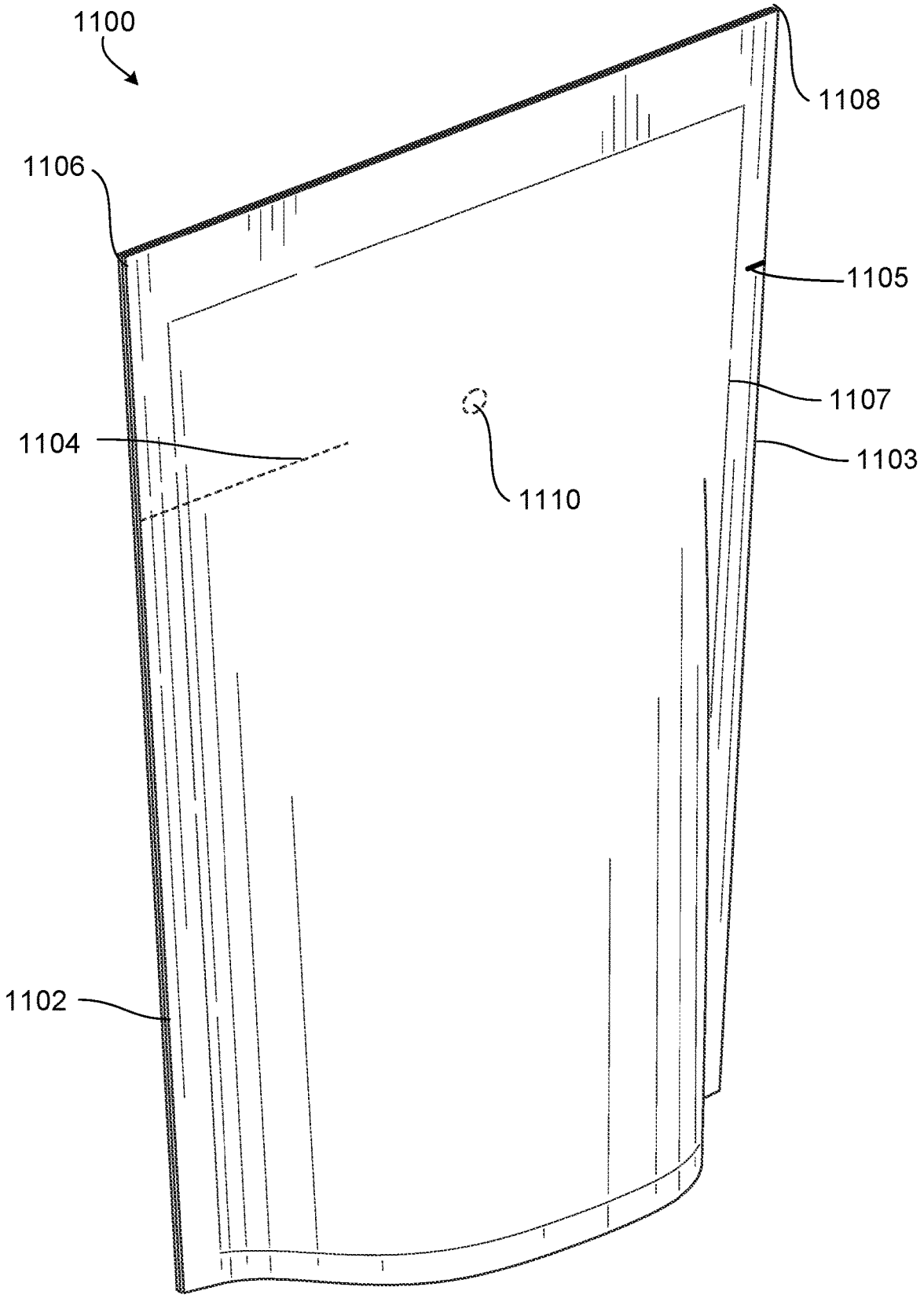
FIG. 11 is a perspective view of a fluid container.

FIG. 11 illustrates a fluid container 1100 that is formed by a flexible, disposable pouch 1102. For example, the pouch 1102 can be formed of a material similar to that of pouch 102 of FIG. 1, e.g., a metal foil material, plastics, a combination of one or more metals and one or more plastics, one or more layers of material, etc.

The pouch 1102 can be sized to hold a variety of fluids. For example, the pouch 1102 can be sized to hold 5 ounces, 10 ounces, 15 ounces, etc. In some implementations, the pouch is sized to hold between 8 ounces and 10 ounces of fluid. In some implementations, the pouch is sized to hold between 9 and 10 ounces of fluid. In some implementations, the pouch is sized to hold between 8 and 20 ounces of fluid.

The pouch 1102 includes a tear line 1104 on a top corner 1106 of the pouch 1102. The tear line 1104 can include, e.g., a perforation in the pouch 1102, a section of the pouch 1102 having thinner walls, etc. In some implementations, the tear line 1104 can include a pre-made tear on at least a portion of the corner 1106. The pre-made tear can allow a user to more easily tear the corner 1106 off the pouch 1102. In some implementations, the tear line 1104 can include a perforation (e.g., a series of holes that serves as an aid in separation). Different geometries of perforation can be used. For example, the holes can be, e.g., slits, circular holes, triangular holes, etc. The perforations can be formed by, e.g., pinner perforation rollers, die and punch, laser perforation, etc. The perforation creates a long series of slits so that the plastic can be torn easily along the tear line 1104. Once the user tears the corner 1106 off the pouch 1102, the user can access the fluid (e.g., beverage) contained within the pouch 1102. In some implementations, the pouch 1102 includes a tear line on a second top corner 1108 of the pouch. In some implementations, the pouch 1102 includes a tear line on or near each of top corners 1106, 1108. The pouch 1102 may also include a pre-made tear 1105 in the side of the pouch opposite to tear line 1104, such that the tear line 1104 is approximately parallel to the pre-made tear 1105, and such that the tear line 1104 and the pre-made tear 1105 are located at approximately the same distance from a top of the pouch 1114. The pre-made tear extends approximately half-way from the outside of the smooth edge of the pouch 1103 to the edge of the liquid reservoir within the pouch 1107. The tear line 1104 and pre-made tear 1105 are aligned such that tearing the tear line 1104 may allow a user to tear the top of the pouch entirely from the tear line 1104 to the pre-made tear 1105. As the user tears the pouch along the tear line 1104, the pouch deforms and is configured to guide the tear linearly to connect to the pre-made tear 1105. This full tear of the top of the pouch allows the user increased access to the contents of the drink. This enables users to pour additional liquid into the pouch, or to add various desired ingredients to the pouch (e.g. liquid IV, vitamin C, water flavoring powder, etc.). This also allows users to easily pour the drink out into another container.

The pouch 1102 also includes a pierceable hole 1110. The hole 1110 can include, e.g., a perforation in the pouch 1102, a section of the pouch 1102 having thinner walls, etc. to allow a user to easily pierce the hole, e.g., with a straw. In some implementations, the hole 1110 has a circular geometry (e.g., a 4 mm diameter, a 6 mm diameter, a diameter between 4 mm and 10 mm, a diameter between 1 mm and 10 mm, etc.); however, one or more other geometries maybe utilized (e.g., rectangular shapes, etc.). The pouch 1102 can include indicia to indicate the location of the pierceable hole 1110. For example, text on the pouch 1102 can indicate the location of the hole 1110. In some implementations, colors of the pouch 1102 can indicate the location of the hole 1110. In some implementations, the hole 1110 can act as a hole for a straw so that a user can drink the beverage through a straw. In some implementations, the hole 1110 can act as a vent. For example, the hole 1110 can act as a vent when a user tears the top corner 1106 off the pouch 1102. If the user wants to drink the beverage from the torn corner or pour the beverage from the top corner, the vent can allow air to enter the pouch 1102. Allowing air to enter the pouch assists the user in drinking and pouring the beverage, so that little effort is required by the user.

The size, position, etc. of the hole 1110 can vary. For example, in some implementations, the hole 1110 can be located on a side of the pouch. In some implementations the hole 1110 can be larger, and in some implementations the hole 1110 can be smaller. In some implementations, the fluid container 1100 can include multiple holes. The multiple holes can be similar or different from each other.

Figure 12:
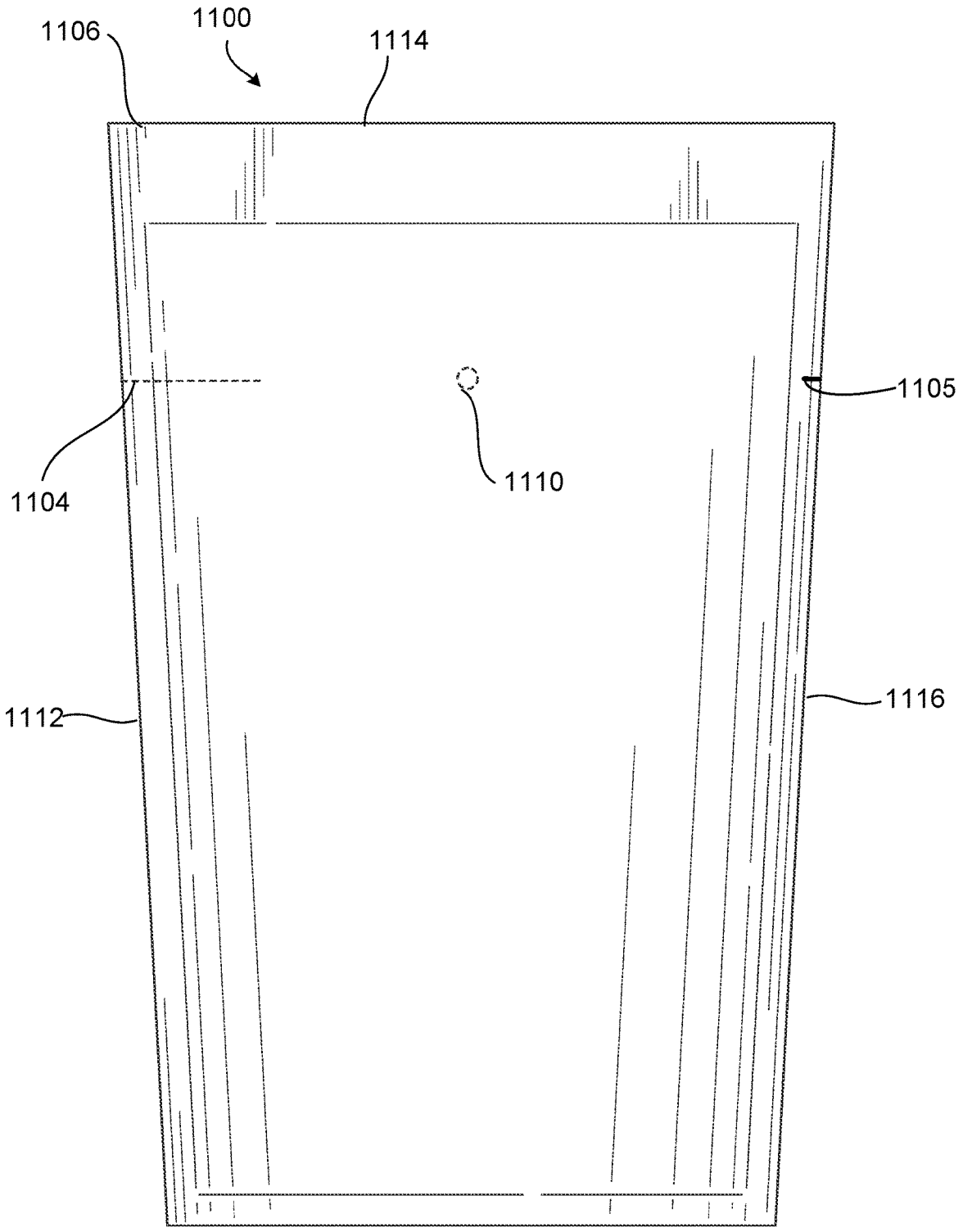
FIG. 12 is a front view of a fluid container.

FIG. 12 illustrates front view of the fluid container 1100. The tear line 1104 is presented normal to the view presented in FIG. 12. The tear line 1104 can extend horizontally from a side 1112 of the pouch 1102. The tear line 1104 can define a rectangular shaped portion in the corner 1106 of the pouch 1102. The pre-made tear 1105 is presented normal to the view presented in FIG. 12. The pre-made tear 1105 can extend horizontally from a side 1116 of the pouch 1102. As discussed above, the pre-made tear is located at approximately the same distance from the top of the pouch as the tear line 1104. In some implementations the pre-made tear 1105 can be positioned at a distance from the top of the pouch 1114 that is larger or smaller compared to the distance that the tear line 1104 is positioned from the top of the pouch 1114. In the illustrated example, the tear line 1104 has extends horizontal from the side 1112; however, the tear line may extend along other directions. For example, the tear line 1104 can be extend perpendicular to the side 1112 (to account for a tapered geometry of the side 1112) or in other angles relative to the side 1112, for example, at 5 degree angle (upward or downward) relative to the side 1112.

In some implementations, the surfaces near the tear line can be smooth, such that the user is comfortable placing his or her mouth on the pouch. For example, the tear line can be configured such that a smooth edge is left on the pouch. This can prevent a user from cutting his or her lips, fingers, etc. while drinking from the pouch.

The geometry of the pouch 1102 can vary. In the illustrated embodiment, sides 1112, 1116 of the pouch are not parallel. For example, the sides 1112, 1116 are tapered. In some embodiments, the sides 1112, 1116 are parallel. In some implementations, the sides 1112, 1116 can include surface features (e.g., grips, features that increase friction, etc.) to assist a user with holding the pouch.

Figure 13:
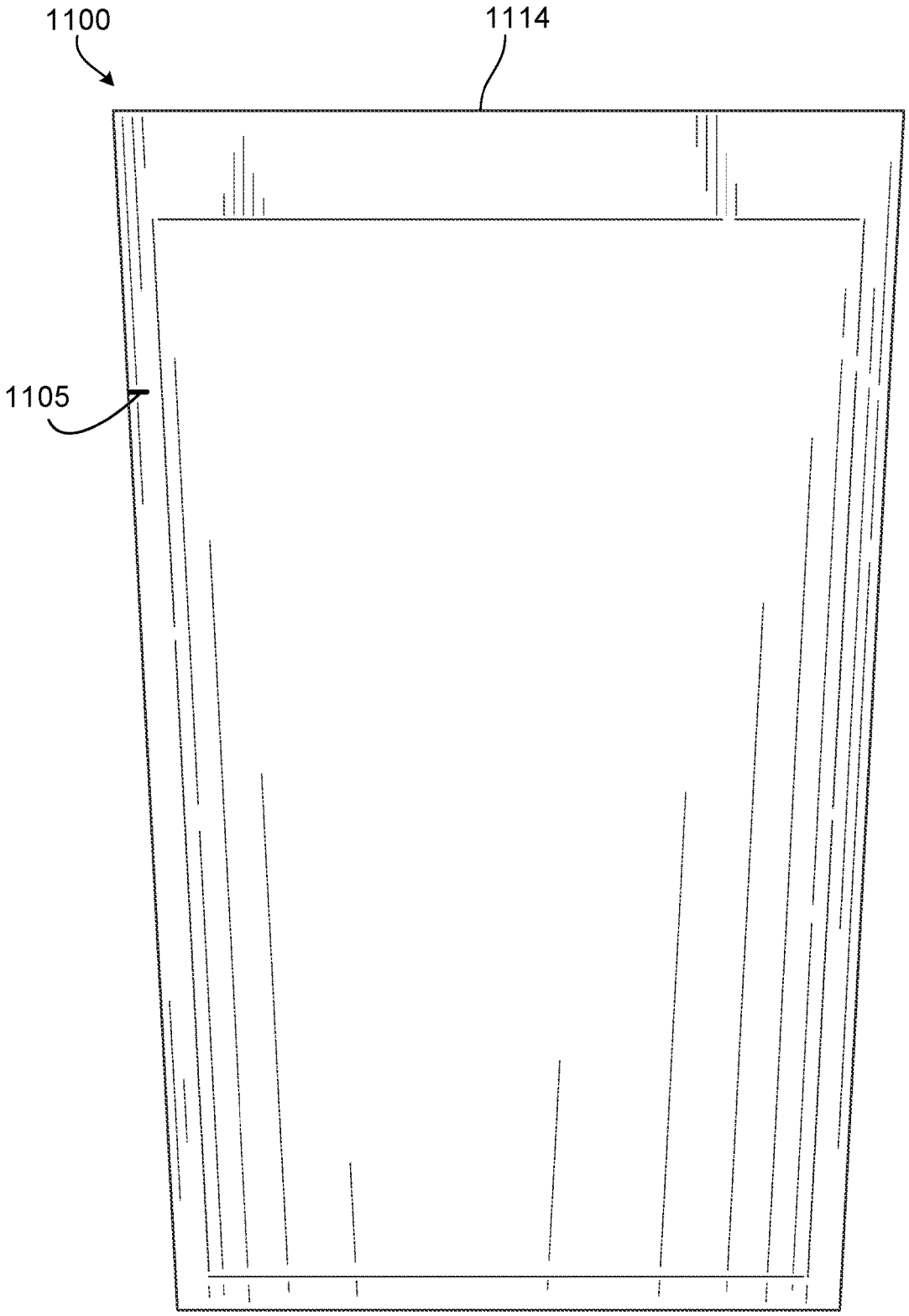
FIG. 13 is a back view of a fluid container.

FIG. 13 illustrates a back view of the fluid container 1100. In the illustrated implementation, the back of the pouch 1102 does not include a pierceable hole; however, in some implementations, the back of the pouch 1102 includes a hole similar to the hole 110. In some implementations having a hole on the back of the pouch, the hole on the back of the pouch 1102 can be different than a hole on the front of the fluid container. In some implementations, the pouch 1102 can have a hole on the back of the pouch, and the pouch does not have a hole on the front of the pouch. The back of the pouch 1102 also does not include a tear line in the illustrated implementation; however, in some implementations the back of the pouch 1102 includes a tear line similar to the hole 1104. In some implementations having a tear line on the back of the pouch, the tear line on the back of the pouch 1102 can be different than the tear line on the front of the pouch. In some implementations, the pouch 1102 can have a tear line on the back of the pouch, and the pouch does not include a tear line on the front of the pouch. As illustrated, the pre-made tear 1105 appears on a back side of the pouch. This allows a user to easily tear through the front and back side of the pouch.

Figure 14:
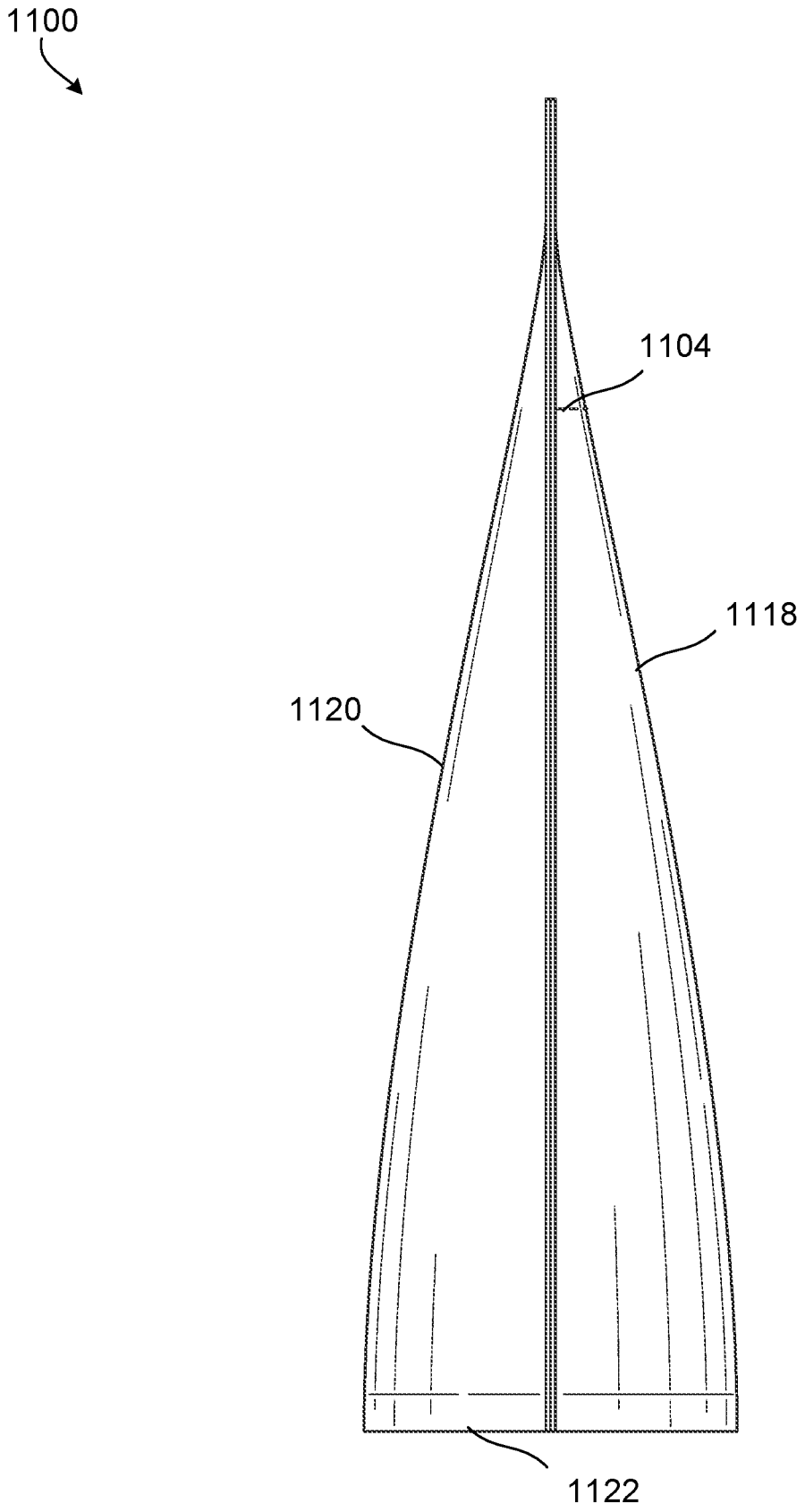
FIG. 14 is a left side view of a fluid container.
Figure 15:
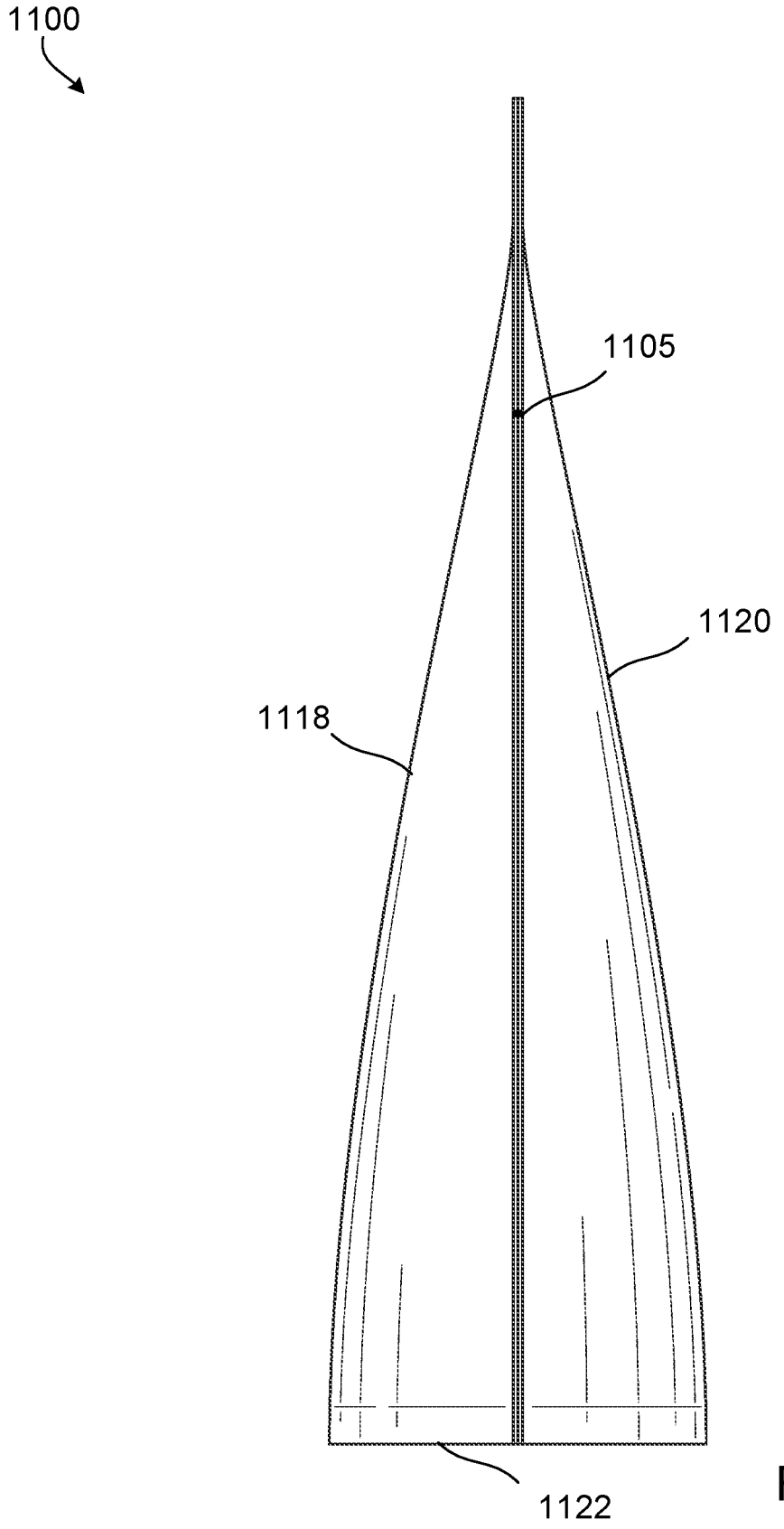
FIG. 15 is a right side view of a fluid container.

FIGS. 14 and 15 illustrate a left side view of the fluid container 1100 and a right side view of the fluid container 1100, respectively. Tear line 1104 is illustrated in the left side view of the fluid container 1100. As illustrated, the tear line 1104 appears on a front side 1118 to define a rectangular shaped portion on the front surface of the pouch 1102. This allows a user to easily tear through the front side 1118 of the pouch. In some implementations, the front side 1118 and the back side 1120 of the pouch include tear lines to form rectangular shaped portions on the front surface of the pouch 1102 and the back surface of the pouch 1102. In some implementations, the front side 1118, the back side 1120, other portions of the pouch, etc. can include surface features (e.g., grips, features that increase friction, etc.) to assist a user with holding the pouch. As illustrated in FIG. 15, the pre-made tear appears on the right view of the pouch. This allows a user to easily tear through the front and back side of the pouch and allows the use to tear either from the tear line 1104 to the pre-made tear 1105, or vice versa.

When filled with liquid, the pouch 1102 is thicker at a bottom 1122 of the pouch than at the top 1114 of the pouch. The weight distribution of the liquid contained within the pouch 1102 allows the pouch to stand upright, e.g., so that liquid does not spill from the hole 1110 or an open corner of the pouch 1102. The pouch 1102 becomes flatter as liquid is removed from the pouch. Because the pouch 1102 is flexible, a user can easily deform the pouch 1102 to a desired shape. For example, the user can squeeze the pouch 1102 to remove liquid from the pouch 1102 at a faster rate.

Figure 16:
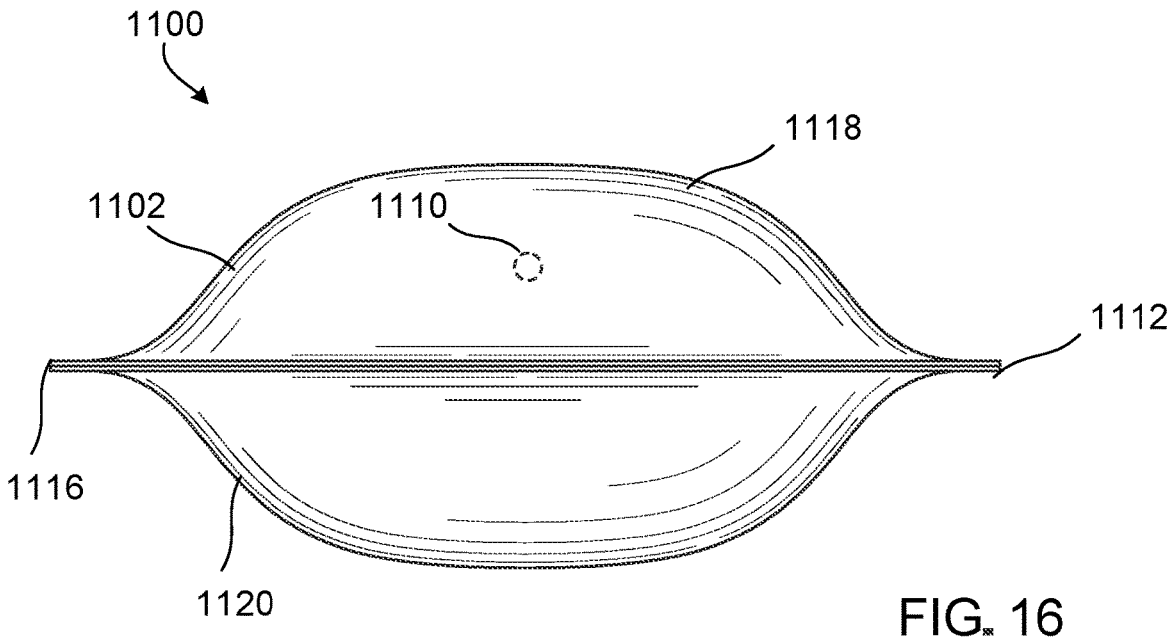
FIG. 16 is a top view of a fluid container.

FIG. 16 illustrates a top view of the fluid container 1100. The hole 1110 is visible on the front side 1118 of the pouch 1102. In some implementations, the hole 1110 is closer to the top 1114 of the pouch 1102 or closer to one of the sides 1112, 1116 of the pouch. In some implementations, the front side 1118 and the back side 1120 extend a smaller distance from the center of the pouch, e.g., to form a thinner pouch. As discussed above, the weight distribution of the pouch can be designed, e.g., to allow the pouch to stand upright.

Figure 17:
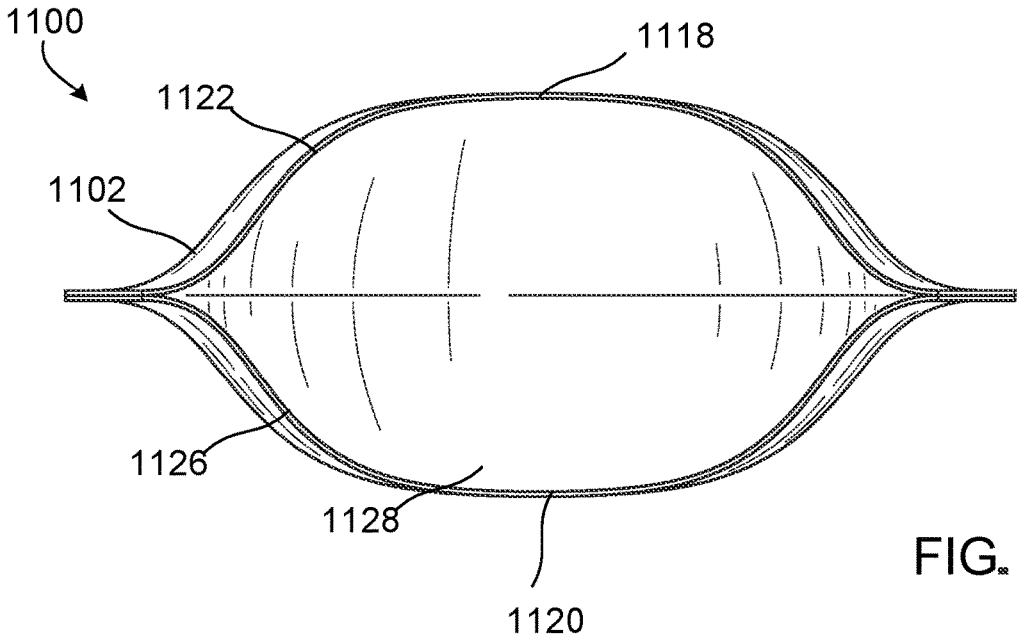
FIG. 17 is a bottom view of a fluid container.

FIG. 17 illustrates a bottom view of the fluid container 1100. The pouch 1102 includes two lips 1124, 1126 that form a base extending from the bottom of the pouch 1102 to stand the pouch 1102 upright. The lips 1122, 1126 can be similar to the lips 122 126 of FIG. 7 above.

Figure 18:
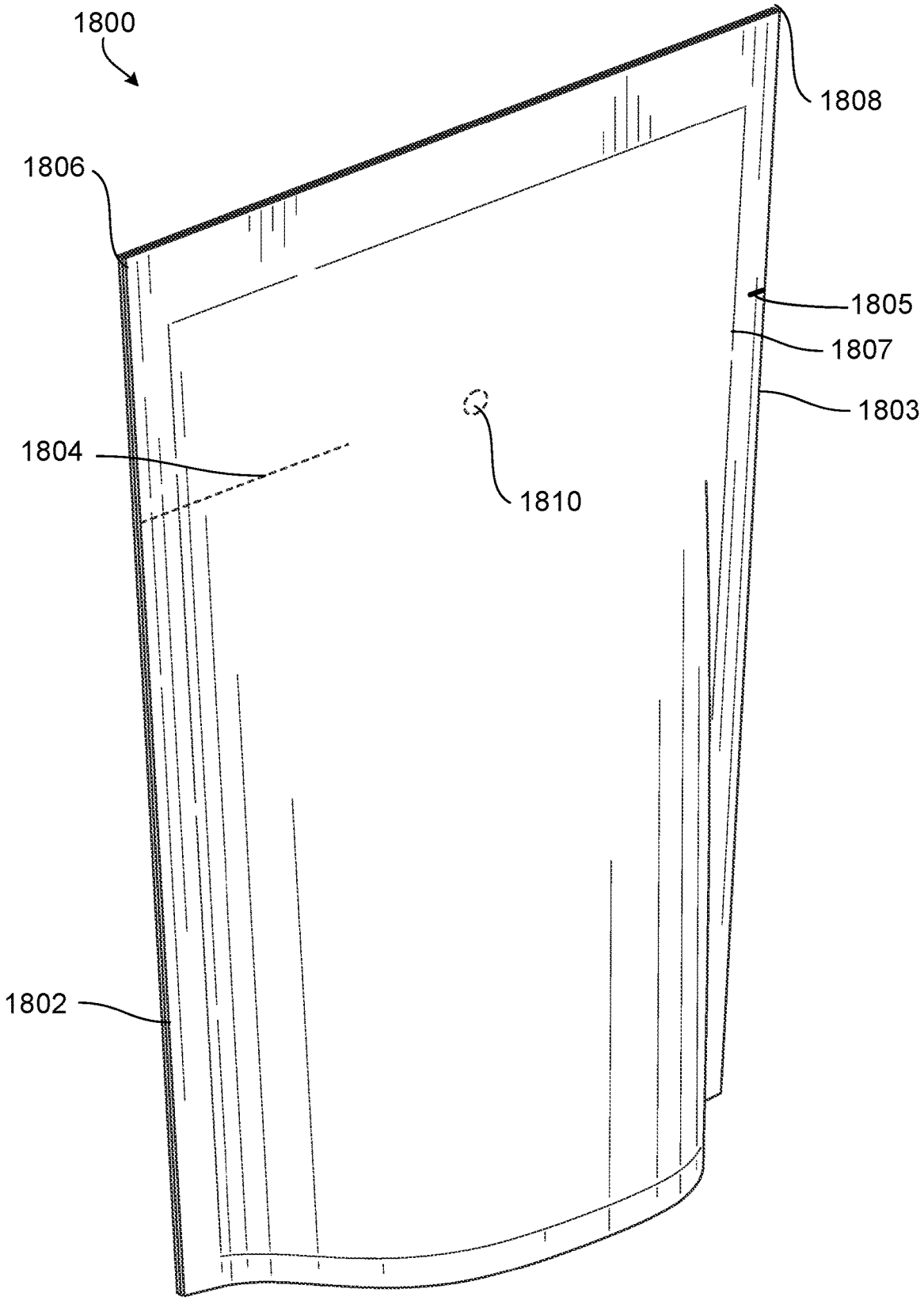
FIG. 18 is a perspective view of a fluid container.

FIG. 18 illustrates a fluid container 1800 that is formed by a flexible, disposable pouch 1802. For example, the pouch 1802 can be formed of a material similar to that of pouch 102 of FIG. 1, e.g., a metal foil material, plastics, a combination of one or more metals and one or more plastics, one or more layers of material, etc.

The pouch 1802 can be sized to hold a variety of fluids. For example, the pouch 1802 can be sized to hold 5 ounces, 10 ounces, 15 ounces, etc. In some implementations, the pouch is sized to hold between 8 ounces and 10 ounces of fluid. In some implementations, the pouch is sized to hold between 9 and 10 ounces of fluid. In some implementations, the pouch is sized to hold between 8 and 20 ounces of fluid.

The pouch 1802 includes a tear line 1804 on a top corner 1806 of the pouch 1802. The tear line 1804 can include, e.g., a perforation in the pouch 1802, a section of the pouch 1802 having thinner walls, etc. In some implementations, the tear line 1804 can include a pre-made tear on at least a portion of the corner 1806. The pre-made tear can allow a user to more easily tear the corner 1806 off the pouch 1802. In some implementations, the tear line 1804 can include a perforation (e.g., a series of holes that serves as an aid in separation). Different geometries of perforation can be used. For example, the holes can be, e.g., slits, circular holes, triangular holes, etc. The perforations can be formed by, e.g., pinner perforation rollers, die and punch, laser perforation, etc. The perforation creates a long series of slits so that the plastic can be torn easily along the tear line 1804. Once the user tears the corner 1806 off the pouch 1802, the user can access the fluid (e.g., beverage) contained within the pouch 1802. In some implementations, the pouch 1802 includes a tear line on a second top corner 1808 of the pouch. In some implementations, the pouch 1802 includes a tear line on both top corners 1806, 1808. The pouch 1802 may also include a pre-made tear 1805 in the side of the pouch opposite to tear line 1804, such that the tear line 1804 is approximately parallel to the pre-made tear 1805, and such that the tear line 1804 and the pre-made tear 1805 are located at approximately the same distance from the top of the pouch. The pre-made tear extends approximately half-way from the outside of a smooth edge of the pouch 1803 to an edge of the liquid reservoir within the pouch 1807. The tear line 1804 and pre-made tear 1805 are aligned such that tearing the tear line 1804 may allow a user to tear the top of the pouch entirely from the tear line 1804 to the pre-made tear 1805. As the user tears the pouch along the tear line 1804, the pouch deforms and is configured to guide the tear linearly to connect to the pre-made tear 1805. This full tear of the top of the pouch allows the user increased access to the contents of the drink. This enables users to pour additional liquid into the pouch, or to add various desired ingredients to the pouch (e.g. liquid IV, vitamin C, water flavoring powder, etc.). This also allows users to easily pour the drink out into another container.

The pouch 1802 also includes a pierceable hole 1810. The hole 1810 can include, e.g., a perforation in the pouch 1802, a section of the pouch 1802 having thinner walls, etc. to allow a user to easily pierce the hole, e.g., with a straw. In some implementations, the hole 1810 has a circular geometry (e.g., a 4 mm diameter, a 6 mm diameter, a diameter between 4 mm and 10 mm, a diameter between 1 mm and 10 mm, etc.); however, one or more other geometries maybe utilized (e.g., rectangular shapes, etc.). The pouch 1802 can include indicia to indicate the location of the pierceable hole 1810. For example, text on the pouch 1802 can indicate the location of the hole 1810. In some implementations, colors of the pouch 1802 can indicate the location of the hole 1810. In some implementations, the hole 1810 can act as a hole for a straw so that a user can drink the beverage through a straw. In some implementations, the hole 1810 can act as a vent. For example, the hole 1810 can act as a vent when a user tears the top corner 1806 off the pouch 1802. If the user wants to drink the beverage from the torn corner or pour the beverage from the top corner, the vent can allow air to enter the pouch 1802. Allowing air to enter the pouch assists the user in drinking and pouring the beverage, so that little effort is required by the user.

The size, position, etc. of the hole 1810 can vary. For example, in some implementations, the hole 1810 can be located on a side of the pouch. In some implementations the hole 1810 can be larger, and in some implementations the hole 1810 can be smaller. In some implementations, the fluid container 1800 can include multiple holes. The multiple holes can be similar or different from each other.

Figure 19:
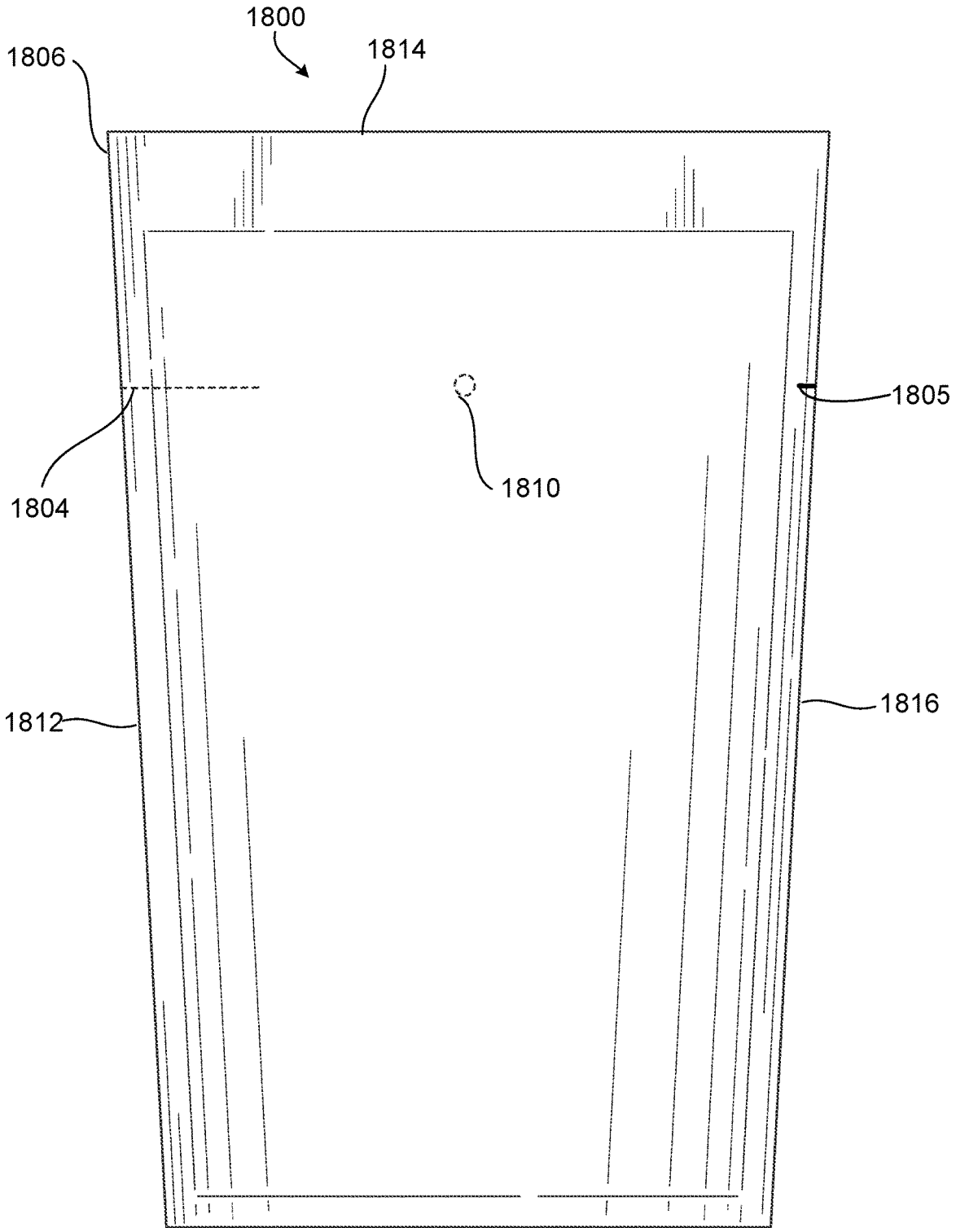
FIG. 19 is a front view of a fluid container.

FIG. 19 illustrates front view of the fluid container 1800. The tear line 1804 is presented normal to the view presented in FIG. 19. The tear line 1804 can extend horizontally from a side 1812 of the pouch 1802. The tear line 184 can define a rectangular shaped portion in the corner 1806 of the pouch 1802. The pre-made tear 1805 is presented normal to the view presented in FIG. 19. The pre-made tear can extend horizontally from a side 1816 of the pouch 1802. As discussed above, the pre-made tear is located at approximately the same distance from the top of the pouch as the tear line 1804 . . . . In some implementations the pre-made tear 1805 can be positioned at a distance from the top of the pouch 1814 that is larger or smaller compared to the distance that the tear line 1804 is positioned from the top of the pouch 1814. In the illustrated example, the tear line 1804 has extends horizontal from the side 1812; however, the tear line may extend along other directions. For example, the tear line 1804 can be extend perpendicular to the side 1812 (to account for a tapered geometry of the side 1812) or in other angles relative to the side 1812, for example, at 5 degree angle (upward or downward) relative to the side 1812.

In some implementations, the surfaces near the tear line can be smooth, such that the user is comfortable placing his or her mouth on the pouch. For example, the tear line can be configured such that a smooth edge is left on the pouch. This can prevent a user from cutting his or her lips, fingers, etc. while drinking from the pouch.

The geometry of the pouch 1802 can vary. In the illustrated embodiment, sides 1812, 1816 of the pouch are not parallel. For example, the sides 1812, 1816 are tapered. In some embodiments, the sides 1812, 1816 are parallel. In some implementations, the sides 1812, 1816 can include surface features (e.g., grips, features that increase friction, etc.) to assist a user with holding the pouch.

Figure 20:
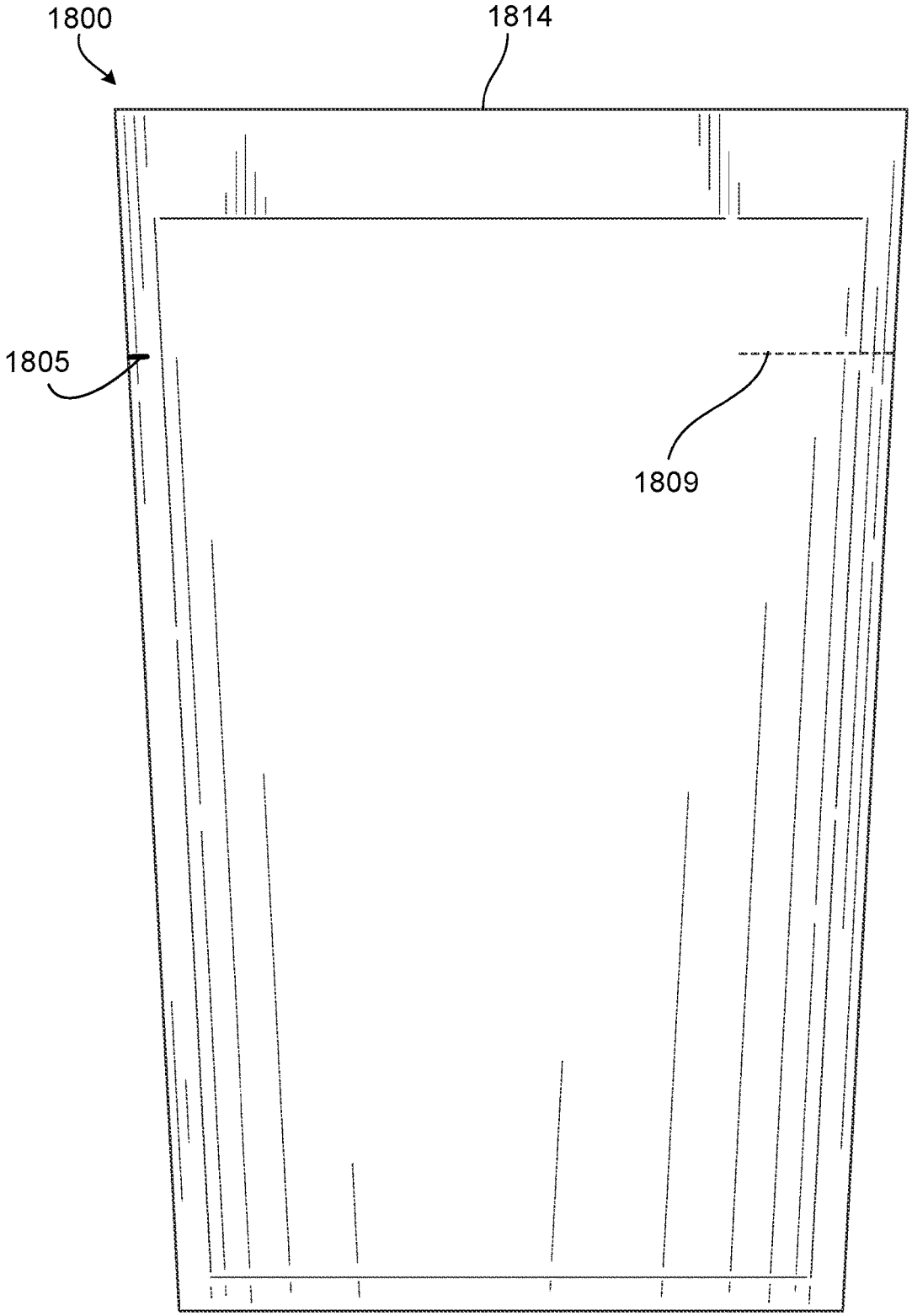
FIG. 20 is a back view of a fluid container.

FIG. 20 illustrates a back view of the fluid container 1800. In the illustrated implementation, the back of the pouch 1802 does not include a pierceable hole; however, in some implementations, the back of the pouch 1802 includes a hole similar to the hole 1810. In some implementations having a hole on the back of the pouch, the hole on the back of the pouch 1802 can be different than a hole on the front of the fluid container. In some implementations, the pouch 1802 can have a hole on the back of the pouch, and the pouch does not have a hole on the front of the pouch. The back of the pouch 1802 also includes a tear line 1809. The tear line 1809 can be similar to the tear line 1804 that is on the front of the pouch, or the tear line 1809 can be different from the tear line 1804, as discussed further below. The back of the pouch 1802 also includes a pre-made tear 1805. This allows a user to easily tear through the front and back side of the pouch and allows the use to tear either from the tear line 1809 to the pre-made tear 1805, or vice versa.

Figure 21:
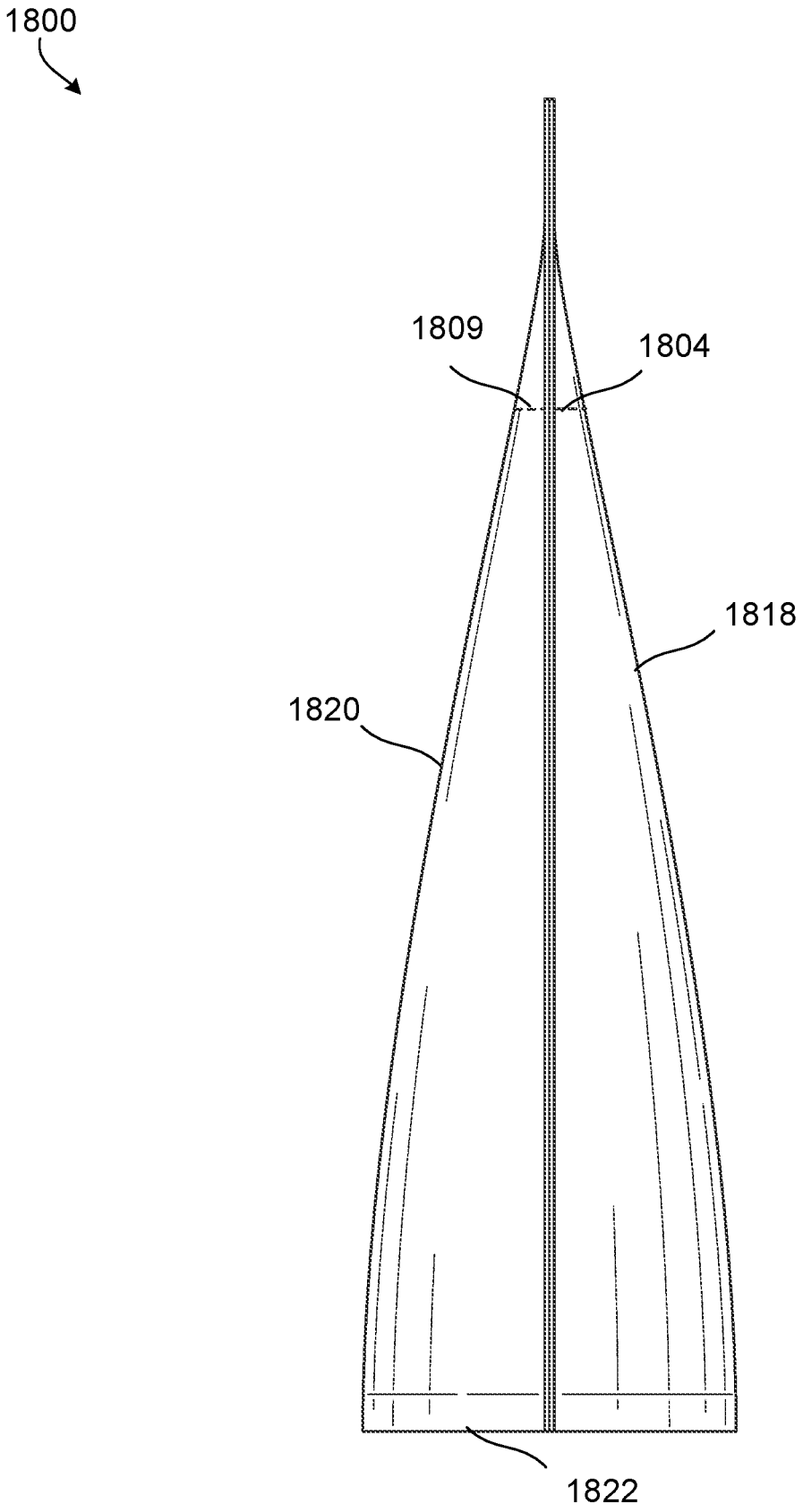
FIG. 21 is a left side view of a fluid container.
Figure 22:
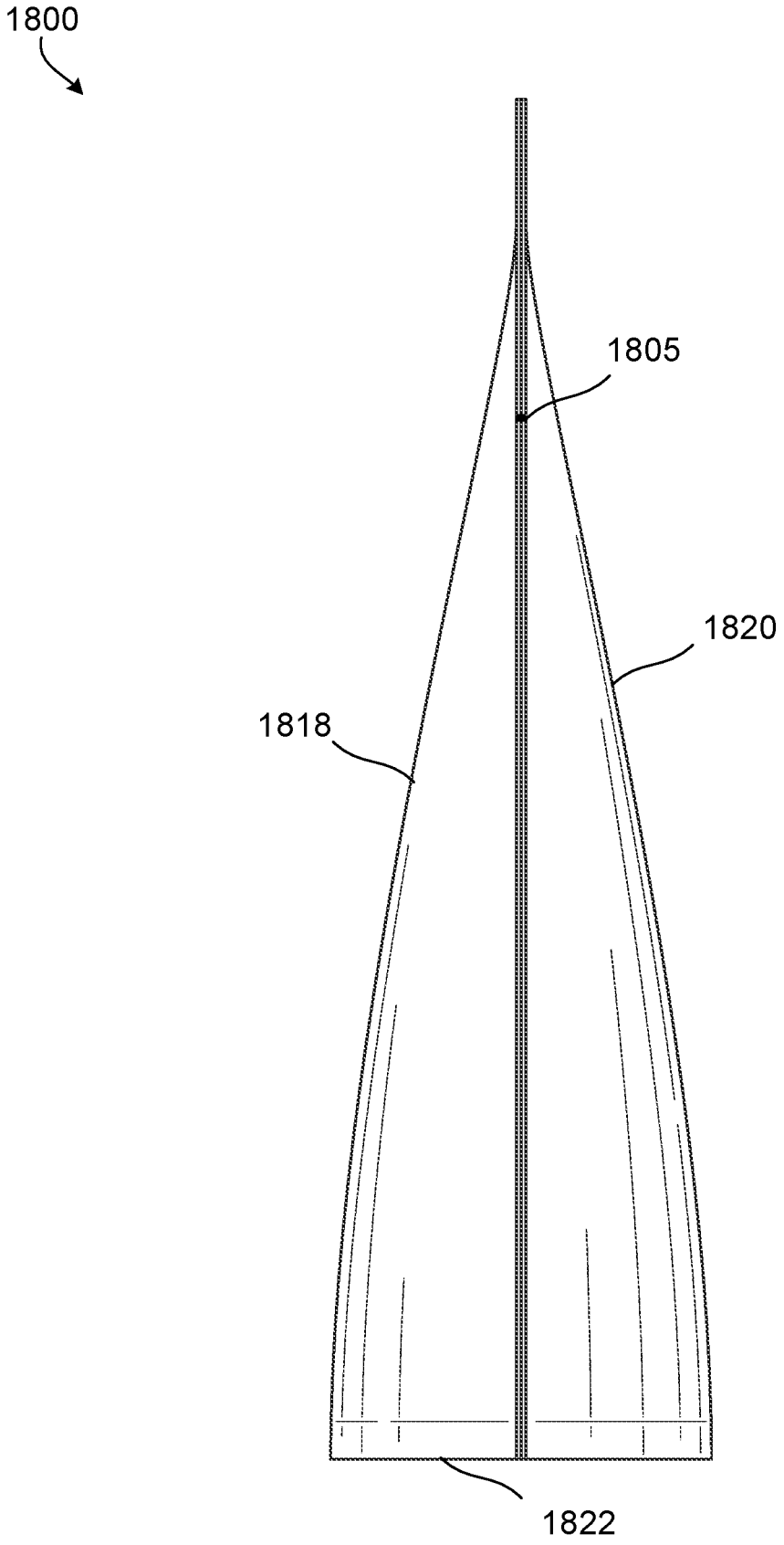
FIG. 22 is a right side view of a fluid container.

FIGS. 21 and 22 illustrate a left side view of the fluid container 1800 and a right side view of the fluid container 1800, respectively. Tear lines 1804, 1809 are illustrated in the left side view of the fluid container 1800. As illustrated, the tear line 1804 appears on a front side 1818 and tear line 1809 appears on a back side 1820 of the fluid container to define rectangular shaped portions on the front surface and back surface of the pouch 1802. This allows a user to easily tear through the front side 1818 and the back side 1820 of the pouch. In some implementations, the front side 1818, the back side 1820, other portions of the pouch, etc. can include surface features (e.g., grips, features that increase friction, etc.) to assist a user with holding the pouch. Although the tear lines 1804, 1809 are illustrated as symmetric, in some embodiments, the tear lines can be different (e.g., asymmetric). For example, the tear line 1804 can extend a different distance than the tear line 1809. In some implementations, the tear line 1804, the tear line 1809, or both of the tear lines 1804, 1809 can be curved. For example, the same, similar, or different curves can be used on the front and back tear lines. For example, the front tear line 1804 can have a particular curve (e.g., having a particular radius) and the back tear line 1809 can have a same curve rotated at 180 degrees. As illustrated in FIG. 22, the pre-made tear appears on a right side view of the pouch. This allows a user to easily tear through the front and back side of the pouch and allows the use to tear either from the tear lines 1804 and 1809 to the pre-made tear 1805, or vice versa.

When filled with liquid, the pouch 1802 is thicker at a bottom 1822 of the pouch than at the top 1814 of the pouch. The weight distribution of the liquid contained within the pouch 1802 allows the pouch to stand upright, e.g., so that liquid does not spill from the hole 1810 or an open corner of the pouch 1802. The pouch 1802 becomes flatter as liquid is removed from the pouch. Because the pouch 1802 is flexible, a user can easily deform the pouch 1802 to a desired shape. For example, the user can squeeze the pouch 1802 to remove liquid from the pouch 1802 at a faster rate.

Figure 23:
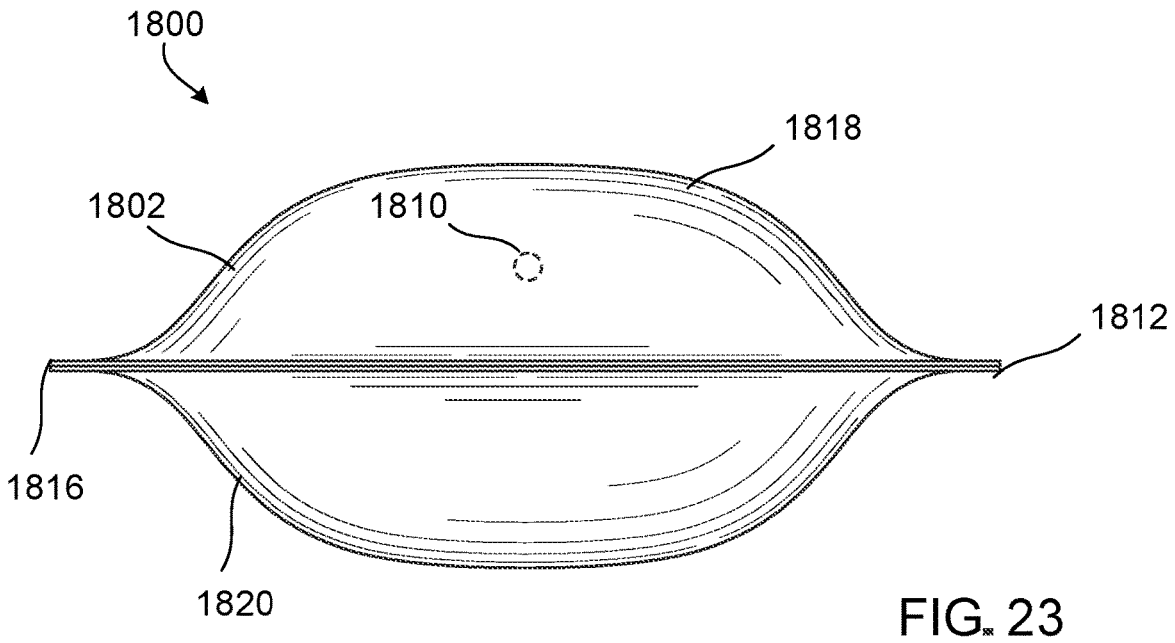
FIG. 23 is a top view of a fluid container.

FIG. 23 illustrates a top view of the fluid container 1100. The hole 1110 is visible on the front side 1118 of the pouch 1102. In some implementations, the hole 1110 is closer to the top 1114 of the pouch 1102 or closer to one of the sides 1112, 1116 of the pouch. In some implementations, the front side 1118 and the back side 1120 extend a smaller distance from the center of the pouch, e.g., to form a thinner pouch. As discussed above, the weight distribution of the pouch can be designed, e.g., to allow the pouch to stand upright.

Figure 24:
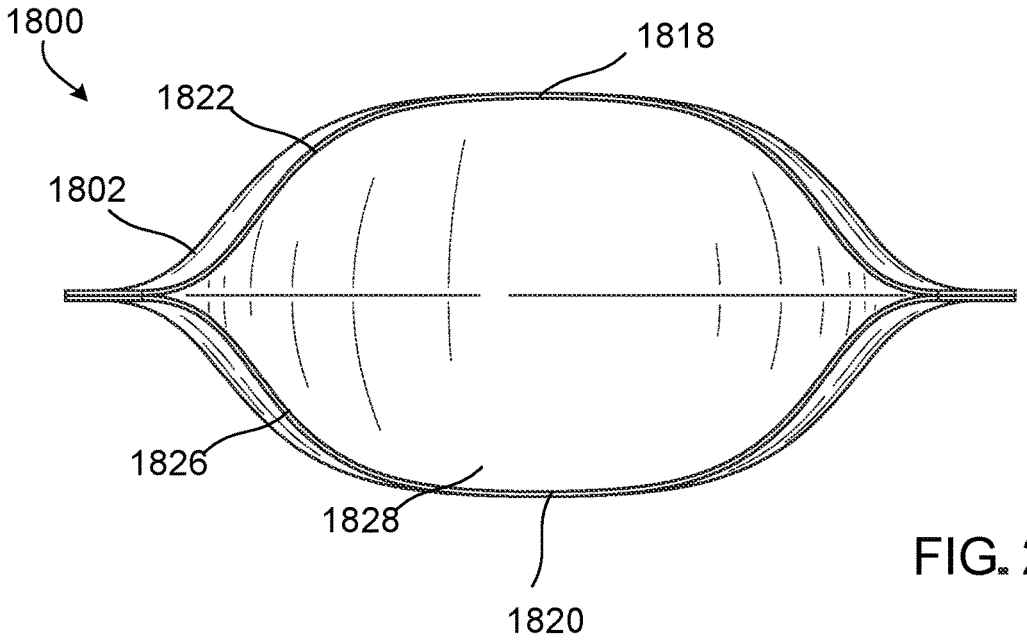
FIG. 24 is a bottom view of a fluid container.

FIG. 24 illustrates a bottom view of the fluid container 1100. The pouch 1102 includes two lips 1124, 1126 that form a base extending from the bottom of the pouch 1102 to stand the pouch 1102 upright. The lips 1124, 1126 can be similar to the lips 124, 126 of FIG. 7 above.

Figure 25:
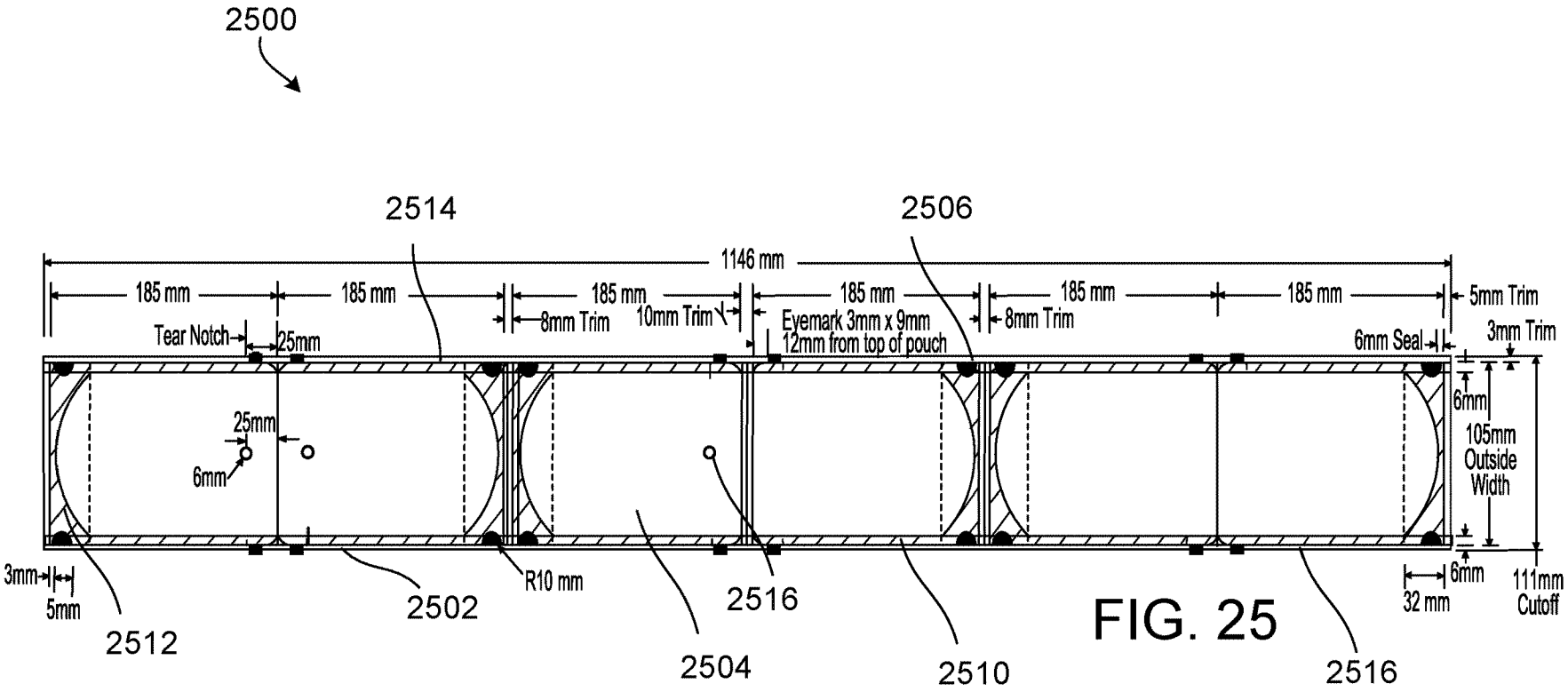
FIG. 25 is an engineering drawing of a fluid container.

FIG. 25 illustrates an engineering drawing of a fluid container 2500. The fluid container 2500 can be similar to, e.g., the fluid container 1100 of FIG. 11. The fluid container 2500 is formed by a flexible, disposable pouch 2502. The pouch 2502 can be a metal foil material, e.g., including aluminum, tin, copper, etc. In some implementations, the pouch 2502 can include plastics, e.g., including polyvinylidene chloride (PVC), low-density polyethylene (LDPE), etc. In some implementations, the pouch 2502 can be formed of a combination of metals and plastics.

The pouch 2502 includes a front panel 2504 and a back panel 2506. When the front panel 2504 and the back panel 2506 are sealed together, they form a reservoir 2508 that can contain fluid, e.g., a beverage. For example, a seal 2510 surrounding the reservoir 2508 can seal the front panel 2504 to the back panel 2506. Additional foil material 2512 can be included on the bottom of the reservoir 2508, e.g., to provide a surface for the pouch 2502 to stand upright, as discussed above. In some implementations, a trim 2516 surrounds the pouch 2502 during manufacturing. The trim 2516 can be removed after or during the manufacturing process and does not remain on the finished product.

The pouch 2502 includes a pre-made tear 2514 in a portion of the seal 2510. For example, the pre-made tear provides a beginning for the user to tear a corner off the pouch 2502. The user therefore does not have to use a lot of effort to start the tear in the corner, as discussed above. The reservoir 2508 remains sealed until a user tears off a portion of the pouch 2502. This can allow a user to easily transport the container 2500 without spilling the fluid in the container. In some implementations, the pre-made tear 2514 is about 25 millimeters (mm) from the top of the pouch 2502. In this embodiment, the pre-made tear 2514 extends perpendicularly across a portion of the front panel 2504, e.g., creating a rectangular portion of the front panel 2504. In some implementations, the pre-made tear can extend different distances across the panels. For example, in the illustrated implementation, the pre-made tear 2504 extends further than a second pre-made tear 2520 in an opposite side of the panel.

The pouch 2502 includes a pierceable hole 2516 in the front panel 2504. The hole 2516 can be similar to the hole 2510 of FIG. 11. The hole 2516 can include, e.g., a perforation in the pouch 2502, a section of the pouch 2502 having thinner walls, etc. to allow a user to easily pierce the hole, e.g., with a straw, toothpick, etc. The pouch 2502 can include indicia to indicate the location of the pierceable hole 2516. For example, text on the pouch 2502 can indicate the location of the hole 2516. In some implementations, colors of the pouch 2502 can indicate the location of the hole 2516. In some implementations, the hole 2516 can act as a hole for a straw so that a user can drink the beverage through a straw. In some implementations, the hole 2516 can act as a vent. For example, the hole 2516 can act as a vent when a user tears the top corner off the pouch 2502, e.g., using the pre-made tear 2514. If the user wants to drink the beverage from the torn corner or pour the beverage from the top corner, the vent can allow air to enter the pouch 2502. Allowing air to enter the pouch assists the user in drinking and pouring the beverage, so that little effort is required by the user. The hole 2516 can have a diameter in a range of about 1 mm to about 10 mm (e.g., 6 mm as illustrated). In some implementations, the hole 2516 is about 25 mm from the top of the pouch. For example, the center of the hole 2516 is about 25 mm from the top of the pouch.

The pouch 2502 can generally have a width in a range of about 100 mm to about 150 mm (e.g., 111 mm as illustrated, 105 mm). The pouch can have a height in a range of about 150 mm to about 300 mm (e.g., 185 mm as illustrated). The pouch 2502 can also have heights and widths outside of these ranges. In some implementations, the seal 2510 can have a width in a range of about 3 mm to about 10 mm (e.g., 6 mm as illustrated). The thickness of the pouch 2502 can vary depending on the amount of liquid in the pouch 2502. In some implementations, the thickness of the pouch 2502 can be in a range of about 60 mm to about 65 mm.

In some implementations, a trim 2516 surrounds the pouch 2502 during manufacturing. The trim 2516 can be removed after or during the manufacturing process and does not remain on the finished product. The trim 2516 can have a width of, e.g., between 1 mm to 5 mm, such as 3 mm.

Figure 26:
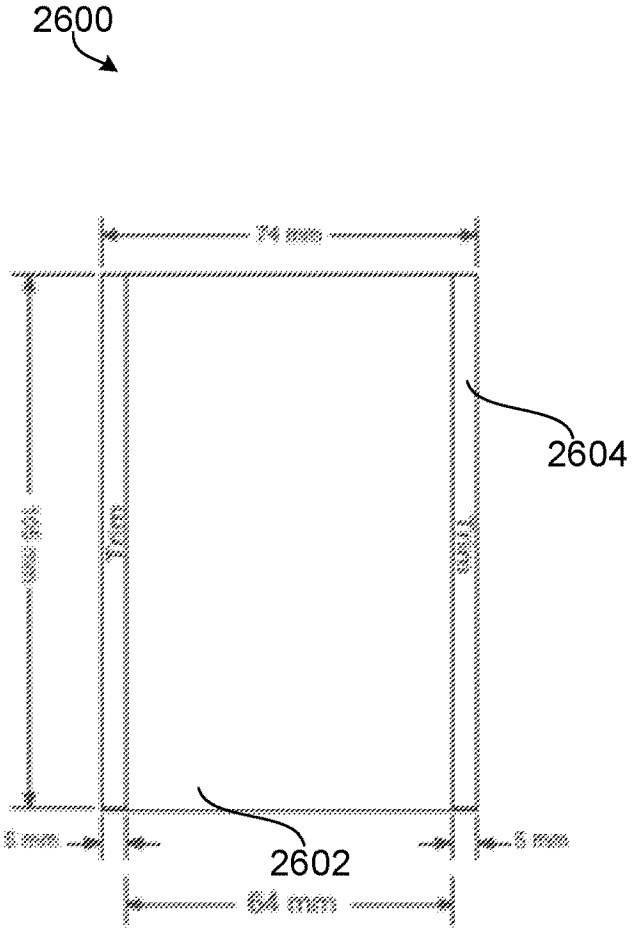
FIG. 26 is an engineering drawing of a gusset forming the bottom of a fluid pouch.

FIG. 26 illustrates an engineering drawing of a gusset 2600 for forming the bottom of a fluid container. For example, the gusset 2600 can be used to form the bottom of the reservoir 1128 of the pouch 1102, illustrated in FIG. 17. The gusset 2600 is formed by a flexible, disposable material 2602, e.g., a metal foil material, e.g., including aluminum, tin, copper, etc. In some implementations, the material 2602 can include plastics, e.g., including polyvinylidene chloride (PVC), low-density polyethylene (LDPE), etc. In some implementations, the material 2602 can be formed of a combination of metals and plastics.

The gusset 2600 has a width in a range of about 50 mm to about 100 mm (e.g., 74 mm as illustrated). The pouch 2600 has a height in a range of about 75 mm to about 150 mm (e.g., 105 mm as illustrated). The gusset can also have heights and widths outside of these ranges. The gusset 2600 can include a trim 2604 that surrounds the gusset 2602 during manufacturing. The trim 2604 can be removed after or during the manufacturing process and does not remain on the finished product. The trim 2604 can have a width of, e.g., between 1 mm to 5 mm, such as 3 mm or 5 mm.

Figure 27:
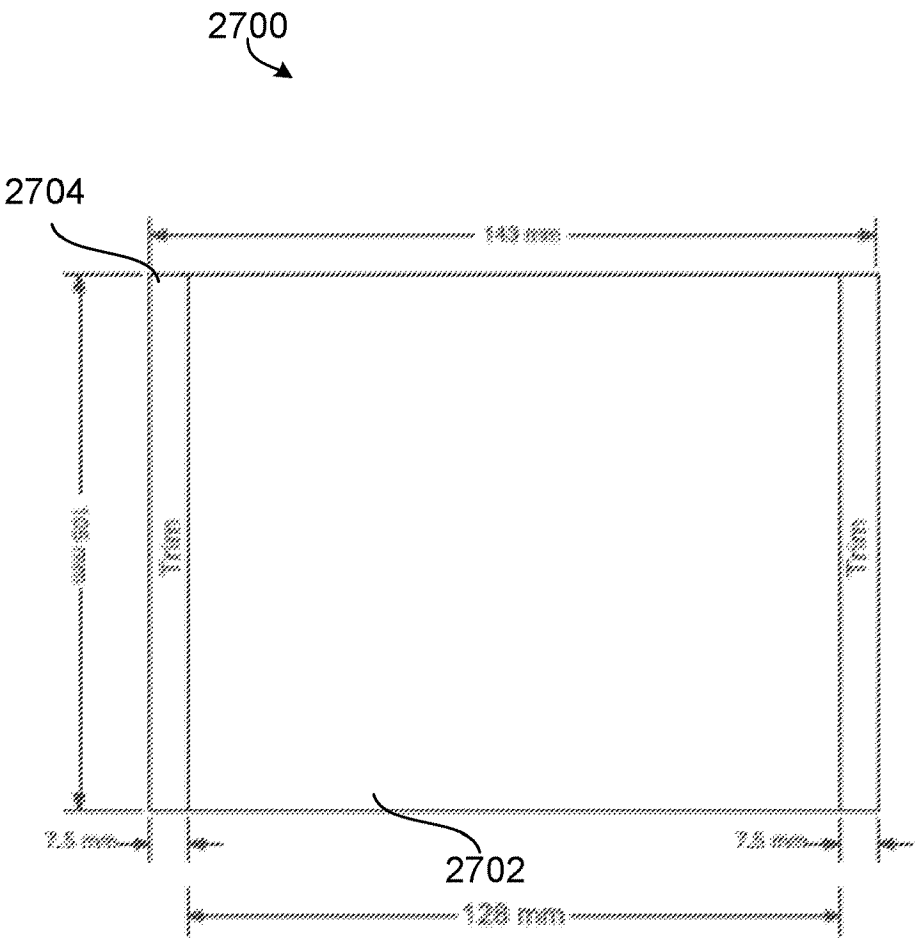
FIG. 27 is an engineering drawing of a gusset forming the bottom of a fluid pouch.

FIG. 27 illustrates an engineering drawing of another gusset 2700 for forming the bottom of a fluid container. For example, the gusset 2700 can be used to form the bottom of the reservoir 1128 of the pouch 1102, illustrated in FIG. 17. The gusset 2700 is formed by a flexible, disposable material 2702, e.g., a metal foil material, e.g., including aluminum, tin, copper, etc. In some implementations, the material 2702 can include plastics, e.g., including polyvinylidene chloride (PVC), low-density polyethylene (LDPE), etc. In some implementations, the material 2702 can be formed of a combination of metals and plastics.

The gusset 2700 can be twice as large as the gusset 2600, e.g., and can be used to form two gussets the size of the gusset 2600. For example, the gusset 2700 has a width in a range of about 100 mm to about 200 mm (e.g., 143 mm as illustrated). The gusset 2700 has a height in a range of about 75 mm to about 150 mm (e.g., 105 mm as illustrated). The pouch can also have heights and widths outside of these ranges. The gusset 2000 can include a trim 2004 that surrounds the pouch 2002 during manufacturing. The trim 2004 can be removed after or during the manufacturing process and does not remain on the finished product. The trim 2004 can have a width of, e.g., between 1 mm to 5 mm, such as 3 mm or 5 mm.

While not described in the figures, an additional embodiment of the pouch may include two or more compartments within the pouch. This enables the pouch to hold different sets of liquids and enables users to mix or keep the liquids separate. Each compartment within the pouch may include a separate venting hole and perforation line, such that a user may separately pour out the liquid contents of each compartment. Users may also use a straw to drink out of the venting hole in each compartment.

A number of embodiments have been described. Nevertheless, it will be understood that various modifications may be made without departing from the spirit and scope of the disclosure. Accordingly, other embodiments are within the scope of the following claims.

What is claimed is:

1. A fluid container comprising:

a flexible pouch formed of a foil material, the flexible pouch defining a fluid reservoir for containing a beverage, the flexible pouch comprising:

a front surface comprising a pierceable vent, wherein the pierceable vent is defined by a circular area of the front surface and a portion of the foil material present in the circular area has a thickness that is thinner than a thickness of another portion of the foil material external to the circular area of the pierceable vent, wherein the pierceable vent comprises a perforation;

a back surface, being opposite the front surface, wherein the back surface and the front surface are sealed together to form the fluid reservoir;

one and only one perforated portion comprising a rectangular shaped portion on a left side of the front surface and a rectangular shaped portion of the back surface, the rectangular shaped portion of the front surface comprising a perforated edge and the rectangular shaped portion of the back surface comprising a perforated edge, wherein the rectangular shaped portion of the front surface is located opposite the rectangular shaped portion of the back surface, the perforated edge of the front surface extends across the front surface perpendicularly relative to a side of the front surface and the perforated edge of the back surface extends across the back surface perpendicularly relative to a side of the back surface, wherein separating a portion of the perforated portion from the front surface and the back surface creates a first opening and exposes the fluid reservoir for user access, wherein the perforated portion comprises perforations having a geometry different from a geometry of the perforation of the pierceable vent;

one and only one tear through a right side of the front surface and through the back surface, wherein the tear does not extend into the fluid reservoir, wherein the tear is partially extendable into the fluid reservoir to create a second opening and expose the fluid reservoir for user access, wherein the perforated portion, the tear, and the pierceable vent are equidistant from a top of the flexible pouch; and a base comprising a front base portion that extends below the front surface and a back base portion that extends below the back surface, wherein the base provides a bottom wall to the fluid reservoir and allows the flexible pouch to stand upright when the fluid reservoir is beverage filled, wherein the bottom wall of the reservoir forms a recess surrounded by the front base portion and the back base portion;

wherein the pierceable vent is positioned apart from the tear and the perforated portion, and wherein the pierceable vent is positioned to allow air to enter the fluid reservoir as fluid is being removed from the fluid reservoir by the first opening provided by the portion of the perforated portion being separated from the front surface and the back surface or by the second opening provided by the tear being extended partially into the fluid reservoir.

2. The fluid container of claim 1, wherein the foil material comprises at least one of polyvinylidene chloride (PVC) and low-density polyethylene (LDPE).

3. The fluid container of claim 1, wherein the pierceable vent has a diameter in a range of 1 millimeter to 10 millimeters.

4. The fluid container of claim 1, wherein the pierceable vent has a diameter of 6 millimeters.

5. The fluid container of claim 1, wherein the fluid reservoir is sized to hold between eight ounces and ten ounces of fluid.

6. The fluid container of claim 1, wherein the perforated portion extends 25 millimeters from a top of the flexible pouch.

7. The fluid container of claim 1, wherein the front surface comprises indicia to indicate the location of the pierceable vent.

8. The fluid container of claim 1, wherein the flexible pouch has a height in a range of 150 millimeters to 300 millimeters.

9. The fluid container of claim 1, wherein the flexible pouch has a width in a range of 100 millimeters to 150 millimeters.

10. The fluid container of claim 1, wherein a center of the pierceable vent is located 25 millimeters from a top of the flexible pouch.

11. A fluid container comprising:

a flexible pouch formed of a foil material, the flexible pouch defining a fluid reservoir for containing a beverage, the flexible pouch comprising:

a front surface comprising a pierceable vent, wherein the pierceable vent is defined by a circular area of the front surface and a portion of the foil material present in the circular area has a thickness that is thinner than a thickness of another portion of the foil material external to the circular area of the pierceable vent, wherein the pierceable vent comprises a perforation;

a back surface, being opposite the front surface, wherein the back surface and the front surface are sealed together to form the fluid reservoir;

one and only one tear through a left side of the front surface and through the back surface, wherein the tear through the left side does not extend into the fluid reservoir, wherein the tear through the left side is configured to be extended partially into the fluid reservoir to create a first opening and expose the fluid reservoir for user access;

one and only one tear through a right side of the front surface and through the back surface, wherein the tear through the right side does not extend into the fluid reservoir, wherein the tear through the right side is configured to be extended partially into the fluid reservoir to create a second opening and expose the fluid reservoir for user access, wherein the tear through the left side, the tear through the right side, and the pierceable vent are equidistant from a top of the flexible pouch; and a base comprising a front base portion that extends below the front surface and a back base portion that extends below the back surface, wherein the base provides a bottom wall to the fluid reservoir and allows the flexible pouch to stand upright when the fluid reservoir is beverage filled, wherein the bottom wall of the reservoir forms a recess surrounded by the front base portion and the back base portion;

wherein the pierceable vent is positioned apart from the tear through the left side and the tear through the right side, and wherein the pierceable vent is positioned to allow air to enter the fluid reservoir as fluid is being removed from the fluid reservoir by the first opening provided by the tear through the left side being extended partially into the fluid reservoir or by the second opening provided by the tear through the right side being extended partially into the fluid reservoir.

12. The fluid container of claim 11, wherein the foil material comprises at least one of polyvinylidene chloride (PVC) and low-density polyethylene (LDPE).

13. The fluid container of claim 11, wherein the pierceable vent has a diameter in a range of 1 millimeter to 10 millimeters.

14. The fluid container of claim 11, wherein the pierceable vent has a diameter of 6 millimeters.

15. The fluid container of claim 11, wherein the fluid reservoir is sized to hold between eight ounces and ten ounces of fluid.

16. The fluid container of claim 11, wherein the perforated portion extends 25 millimeters from a top of the flexible pouch.

17. The fluid container of claim 11, wherein the front surface comprises indicia to indicate the location of the pierceable vent.

18. The fluid container of claim 11, wherein the flexible pouch has a height in a range of 150 millimeters to 300 millimeters.

19. The fluid container of claim 11, wherein the flexible pouch has a width in a range of 100 millimeters to 150 millimeters.

20. The fluid container of claim 11, wherein a center of the pierceable vent is located 25 millimeters from a top of the flexible pouch.

21. The fluid container of claim 1, wherein the perforated portion extends a first distance and the tear extends a second distance, wherein the first distance is greater than the second distance.

22. The fluid container of claim 11, wherein the tear through the left side extends a first distance and the tear through the right side extends a second distance, wherein the first distance is greater than the second distance.

23. The fluid container of claim 11, wherein the tear through the left side and the tear through the right side are asymmetric.

24. The fluid container of claim 11, wherein the foil container includes a combination of one or more metals and one or more plastics.

25. The fluid container of claim 11, wherein the flexible pouch comprises tapered sides.

26. The fluid container of claim 11, wherein the flexible pouch is wider at a bottom of the flexible pouch than at a top of the flexible pouch.

27. The fluid container of claim 11, wherein the base comprises a domed geometry surrounded by the front base portion and the back base portion.

28. The fluid container of claim 11, wherein the tear through the left side extends half-way from an outside edge of the pouch to an edge of the liquid reservoir.

29. The fluid container of claim 11, wherein the tear through the right side extends half-way from a second outside edge of the pouch to a second edge of the liquid reservoir.

30. The fluid container of claim 11, wherein the tear through the left side extends perpendicularly from a side of the front surface and back surface.

* * * * *